US007749444B2

(12) United States Patent
Yamada et al.

(10) Patent No.: US 7,749,444 B2
(45) Date of Patent: Jul. 6, 2010

(54) MICROFLUIDIC DEVICE, METHOD FOR TESTING REAGENT AND SYSTEM FOR TESTING REAGENT

(75) Inventors: Masayuki Yamada, Toyonaka (JP); Takeshi Matsumoto, Toyonaka (JP); Yasuhiro Sando, Amagasaki (JP); Kusunoki Higashino, Osaka (JP)

(73) Assignee: Konica Minolta Sensing, Inc., Sakai-shi (JP)

( * ) Notice: Subject to any disclaimer, the term of this patent is extended or adjusted under 35 U.S.C. 154(b) by 1169 days.

(21) Appl. No.: 11/024,592

(22) Filed: Dec. 29, 2004

(65) Prior Publication Data

US 2005/0255007 A1 Nov. 17, 2005

(30) Foreign Application Priority Data

May 13, 2004 (JP) ..... 2004-143108

(51) Int. Cl.
*B01N 3/00* (2006.01)

(52) U.S. Cl. ..... 422/81; 422/100; 422/129

(58) Field of Classification Search ..... 422/81, 422/100, 129

See application file for complete search history.

(56) References Cited

U.S. PATENT DOCUMENTS

| | | | | |
|---|---|---|---|---|
| 5,725,363 | A | 3/1998 | Büstgens | 417/413.1 |
| 5,846,396 | A | 12/1998 | Zanzucchi et al. | 204/601 |
| 6,033,628 | A | 3/2000 | Kaltenbach et al. | 422/68.1 |
| 6,068,752 | A | 5/2000 | Dubrow et al. | 204/604 |
| 6,176,962 | B1 | 1/2001 | Soane et al. | 156/292 |
| 6,251,343 | B1 | 6/2001 | Dubrow et al. | 422/102 |
| 6,254,754 | B1 | 7/2001 | Ross et al. | 204/548 |
| 6,447,661 | B1 * | 9/2002 | Chow et al. | 204/453 |
| 6,458,325 | B1 | 10/2002 | Roscher et al. | 422/68.1 |

(Continued)

FOREIGN PATENT DOCUMENTS

EP 0 568 902 A2 11/1993

(Continued)

OTHER PUBLICATIONS

S. R. Quake et al., "From Micro- to Nanofabrication With Soft Materials", *Issues in Nanotechnology Review, Science*, Nov. 24, 2000, vol. 290, pp. 1536-1540.

(Continued)

*Primary Examiner*—Jill Warden
*Assistant Examiner*—Timothy G Kingan
(74) *Attorney, Agent, or Firm*—Sidley Austin LLP

(57) ABSTRACT

A microfluidic device for performing a test on the reagent includes a fill port formed on the chip to inject the reagent into at least one of the channels, one or more heating portions for performing a test on the reagent injected into the channel, and a micropump. An inside of the micropump and a vicinity of the channel connecting to an inlet and an outlet of the micropump are filled with a drive solution that is driven by the micropump, a gas is sealed between the reagent and the drive solution in the channel to prevent the reagent from contacting the drive solution directly, and the micropump directly drives the drive solution in the forward and backward directions, so that the reagent is repeatedly moved to the test portions through the gas in an indirect manner or is repeatedly passed through the test portions through the gas.

24 Claims, 15 Drawing Sheets

U.S. PATENT DOCUMENTS

| | | | | |
|---|---|---|---|---|
| 6,602,791 | B2 | 8/2003 | Ouellet et al. | 438/696 |
| 6,716,002 | B2 | 4/2004 | Higashino | 417/413.2 |
| 6,734,424 | B2 * | 5/2004 | Lennon et al. | 250/288 |
| 6,838,055 | B2 * | 1/2005 | Sando et al. | 422/100 |
| 7,192,559 | B2 * | 3/2007 | Chow et al. | 422/100 |
| 2002/0042125 | A1 * | 4/2002 | Petersen et al. | 435/287.2 |
| 2002/0124896 | A1 | 9/2002 | O'Connor et al. | 137/833 |
| 2002/0155010 | A1 | 10/2002 | Karp et al. | 417/413.2 |
| 2002/0172969 | A1 * | 11/2002 | Burns et al. | 435/6 |
| 2004/0200724 | A1 * | 10/2004 | Fujii et al. | 204/601 |
| 2004/0208794 | A1 * | 10/2004 | Karg et al. | 422/100 |
| 2005/0247866 | A1 * | 11/2005 | Plewa et al. | 250/251 |

FOREIGN PATENT DOCUMENTS

| | | | |
|---|---|---|---|
| JP | 04-086388 | A | 3/1992 |
| JP | 7151060 | A | 6/1995 |
| JP | 9025878 | A | 1/1997 |
| JP | 10-110681 | A | 4/1998 |
| JP | 10-185929 | A | 7/1998 |
| JP | 10-299659 | A | 11/1998 |
| JP | 3120466 | | 10/2000 |
| JP | 2001-322099 | A | 11/2001 |
| JP | 2002048071 | A | 2/2002 |
| JP | 2002-214241 | | 7/2002 |
| WO | WO 02/053290 | A3 | 7/2002 |

OTHER PUBLICATIONS

Wikipedia disclosure of PDMS (http://en.wikipedia.org/wiki/Polydimethylsiloxane (last visited Jun. 22, 2009).

US Office Action dated Oct. 28, 2009 for corresponding U.S. Appl. No. 10/664,436.

* cited by examiner

MICROFLUIDIC DEVICE, METHOD FOR TESTING REAGENT AND SYSTEM FOR TESTING REAGENT

This application is based on Japanese Patent Application No. 2004-143108 filed on May 13, 2004, the contents of which are hereby incorporated by reference.

BACKGROUND OF THE INVENTION

1. Field of the Invention

The present invention relates to a microfluidic device for distributing a small amount of reagent in channels formed on chips to test the reagent. The present invention is used for, for example, gene amplification by a PCR method.

2. Description of the Related Art

Conventionally, Japanese Patent No. 3120466 proposes that a capillary is used as a channel for a reagent or a reaction solution for gene amplification by the PCR method.

More specifically, three vessels containing three liquids whose temperatures differ from one another are prepared. The three liquids are adjusted so as to be a heat denaturation temperature (95° C., for example), an annealing temperature (55° C., for example) and a polymerization temperature (75° C., for example), respectively. One capillary, which is separately prepared, is placed in a manner to soak sequentially in each of the three liquids. A reagent is injected into the capillary and the injected reagent is transported in the capillary using a gas supplied from end portions of the capillary. A three-way valve is switched to control a supply of the gas so that the reagent is provided sequentially in a position of each of the three liquids for each predetermined time interval. The repetition of this operation gives the reagent a temperature cycle.

In addition, another method is also proposed in which three large temperature portions having different temperatures are prepared, a meandering channel is formed to sequentially pass through the three temperature portions plural times and a reagent is transported unidirectionally within the channel.

Meanwhile, in recent years, a μ-TAS (Micro Total Analysis System) has drawn attention that uses a micromachining technique to microfabricate equipment for a chemical analysis or a chemical synthesis and then to perform the chemical analysis or the chemical synthesis in a microscale method. Compared to the conventional systems, a miniaturized μ-TAS has advantages in that required sample volume is small, reaction time is short, the amount of waste is small and others. The use of the μ-TAS in the medical field lessens the burden of patients by reducing volume of specimen such as blood, and lowers the cost of examination by reducing reagent volume. Further, the reduction of the specimen and reagent volume causes reaction time to shorten substantially, ensuring that examination efficiency is enhanced. Moreover, since the μ-TAS is superior in portability, it is expected to apply to broad fields including the medical field and an environmental analysis.

Japanese unexamined patent publication No. 2002-214241 discloses a technique in which such a μ-TAS is used to transport a reagent. According to the patent publication, two micropumps are used to transport two kinds of reagents which are subsequently joined together and the reagents after joining together are reciprocated within one channel after the confluence.

According to an apparatus described in Japanese Patent No. 3120466 mentioned above, the three-way valve is switched to control a supply of the gas, so that a movement amount of the reagent, i.e., a position of the reagent is controlled. Accordingly, positioning of the reagent is far from easy and it is difficult that the reagent is brought to a standstill at a predetermined position correctly and a temperature process using a liquid is performed precisely. In addition, the use of the three vessels and the capillary imposes limitation on reduction in the size of the apparatus. In other words, downsizing and improvement in portability are difficult.

Further, in the case where an apparatus has a meandering channel formed on a microchip and serves to transport a reagent unidirectionally, an amount of the reagent cannot be reduced and a pump is large. Accordingly, downsizing of the apparatus is far from easy.

When a micropump is used to transport a reagent, it is necessary to fill an area extending from the micropump to a portion for a temperature process with the reagent. Accordingly, it is impossible to reduce an amount of the reagent.

SUMMARY OF THE INVENTION

The present invention is directed to solve the problems pointed out above, and therefore, an object of the present invention is to provide a microfluidic device, a method for testing a reagent and a system for testing the same, all of which can perform a test using a small amount of reagent, can accurately control a movement amount of reagent and can perform a test precisely.

According to one aspect of the present invention, a microfluidic device for distributing a reagent in a channel formed on a chip to perform a test on the reagent, the device includes a fill port formed on the chip to inject the reagent into at least one of the channels, one or more test portions for performing a test on the reagent injected into the channel, and a micropump capable of transporting a liquid in forward and backward directions in one end portion of the channel, wherein an inside of the micropump and a vicinity of the channel connecting to an inlet and an outlet of the micropump are filled with a drive solution that is driven by the micropump, a gas is sealed between the reagent and the drive solution in the channel to prevent the reagent from contacting the drive solution directly, and the micropump directly drives the drive solution in the forward and backward directions, so that the reagent is repeatedly moved to the test portions through the gas in an indirect manner or is repeatedly passed through the test portions through the gas in an indirect manner.

Preferably, the chip includes a process chip in which a first channel for distributing the reagent is provided, and a drive chip in which a second channel for transporting the drive solution, the test portions and the micropump are provided, the process chip is removably attached to the drive chip, and the gas passes through a connection portion of the first channel and the second channel.

Further, the test portions are three heating portions having different temperatures, and the reagent is repeatedly moved to the three heating portions in a sequential manner.

The channel is provided with three reagent chambers corresponding to positions of the three heating portions, the reagent chambers being for containing the reagent, and the reagent is capable of being moved to the reagent chambers to be contained therein sequentially.

Further, the reagent chambers are equal to one another in volume and the volume is set so as to be greater than a volume of the reagent that is injected at one time.

A transport volume of the drive solution at one time by driving the micropump is set so as to be equal to a sum of the volumes of the reagent chambers and a volume of the channel connecting the two reagent chambers.

Further, each of the reagent chambers is provided with two electrodes for detecting whether or not the reagent is contained.

Furthermore, an inner circumferential surface of each of the channels connecting the reagent chambers is treated with a water repellent or an oil repellent.

According to another aspect of the present invention, a microfluidic includes a reagent chamber formed on the chip to contain the reagent, a plurality of process chambers divided within the reagent chamber, a plurality of test portions for performing a test on the reagent, the test portions corresponding to the process chambers, and a micropump capable of transporting a liquid in forward and backward directions in one end portion of the channel, wherein an inside of the micropump and a vicinity of the channel connecting to an inlet and an outlet of the micropump are filled with a drive solution that is driven by the micropump, a gas is sealed between the reagent and the drive solution in the channel to prevent the reagent from contacting the drive solution directly, and the micropump directly drives the drive solution in the forward and backward directions, so that the reagent is moved in the reagent chamber through the gas indirectly, causing the reagent to move to the plurality of process chambers sequentially.

Preferably, the chip includes three heating portions so as to correspond to the reagent chamber, the reagent chamber is divided into three process chambers corresponding to the three heating portions, and the reagent is moved in the reagent chamber, so that the reagent moves to the three heating portions sequentially.

In the present invention, a nitrogen gas, air or various other gases are used as a gas.

The present invention enables a test using a small amount of reagent, accurate control of a movement amount of reagent and a test with a high degree of precision.

These and other characteristics and objects of the present invention will become more apparent by the following descriptions of preferred embodiments with reference to drawings.

DESCRIPTION OF THE PREFERRED EMBODIMENTS

First Embodiment

Figure 1:
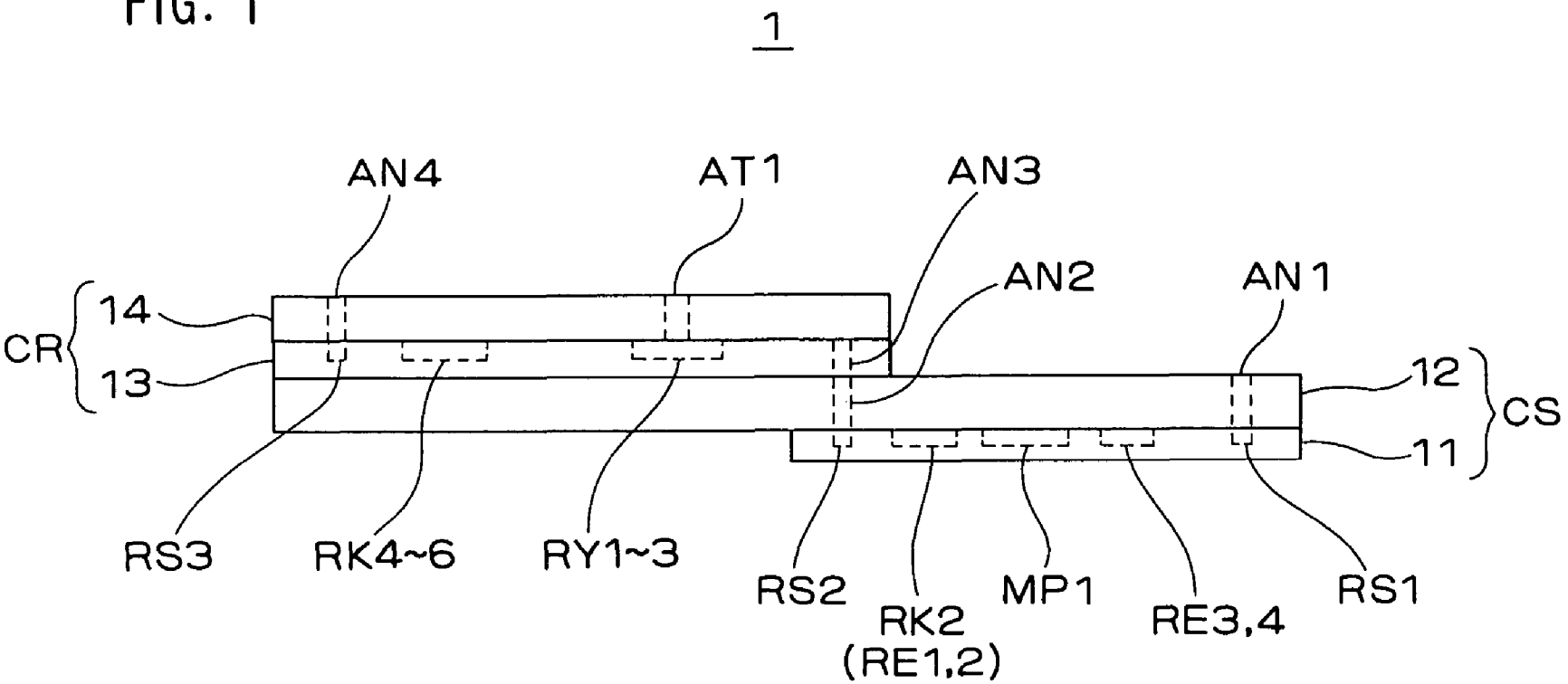
FIG. 1 is a front view of a microfluidic device according to a first embodiment of the present invention.
Figure 2:
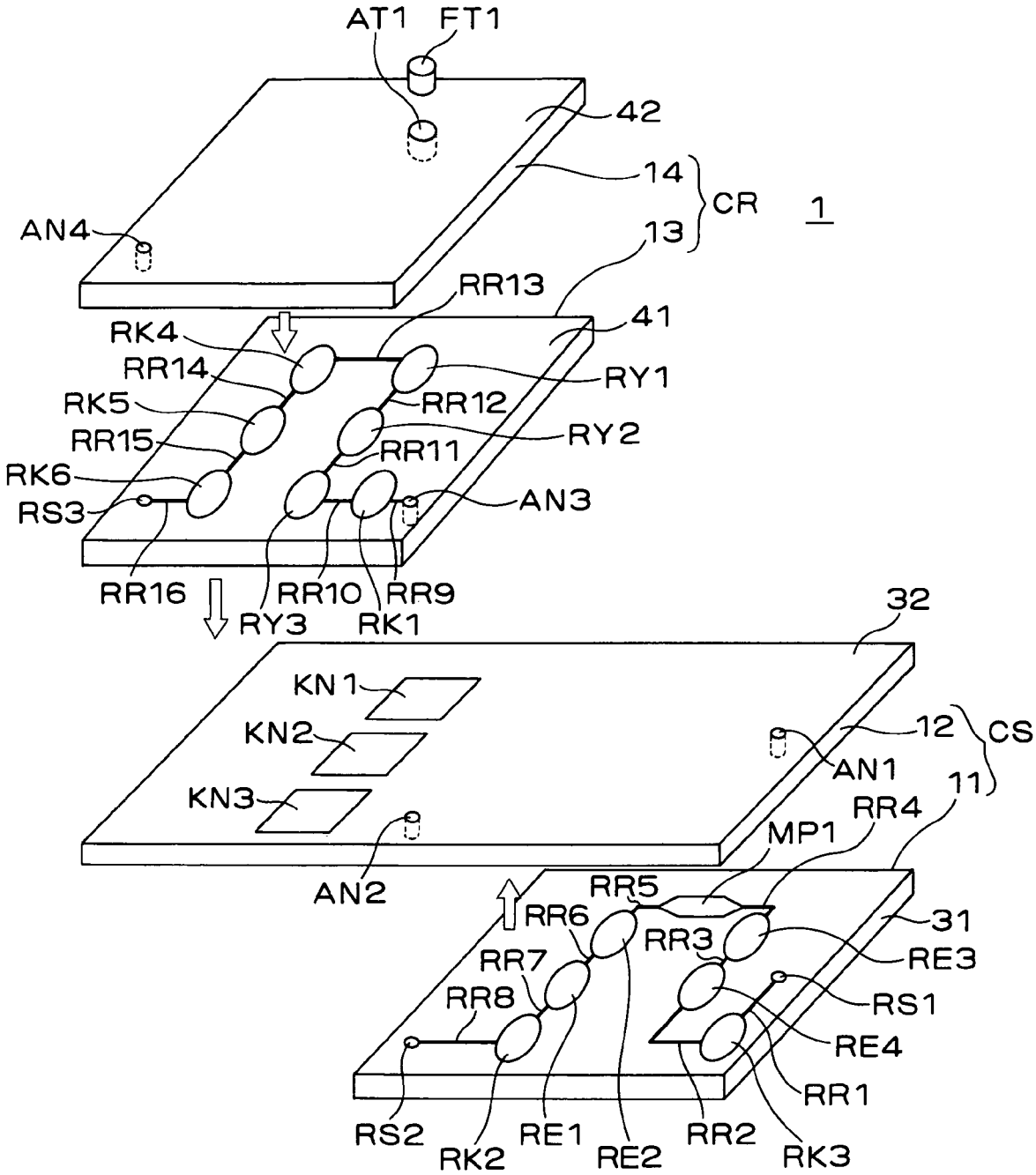
FIG. 2 is an exploded perspective view of a structure of the microfluidic device.
Figure 3:
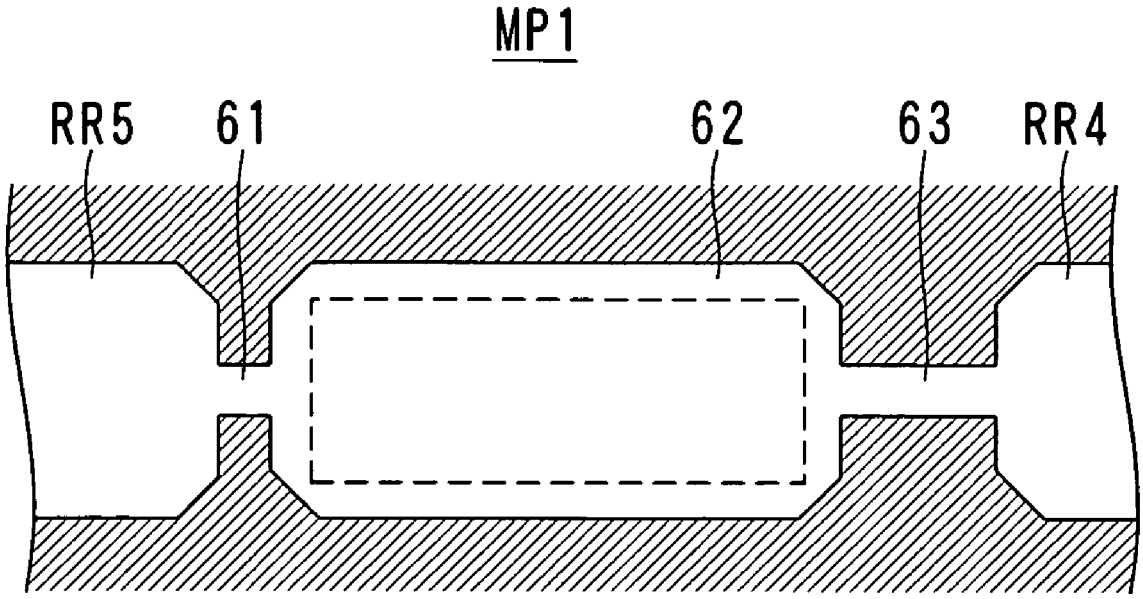
FIG. 3 is a plan view of a micropump shown in FIG. 2.
Figure 4:
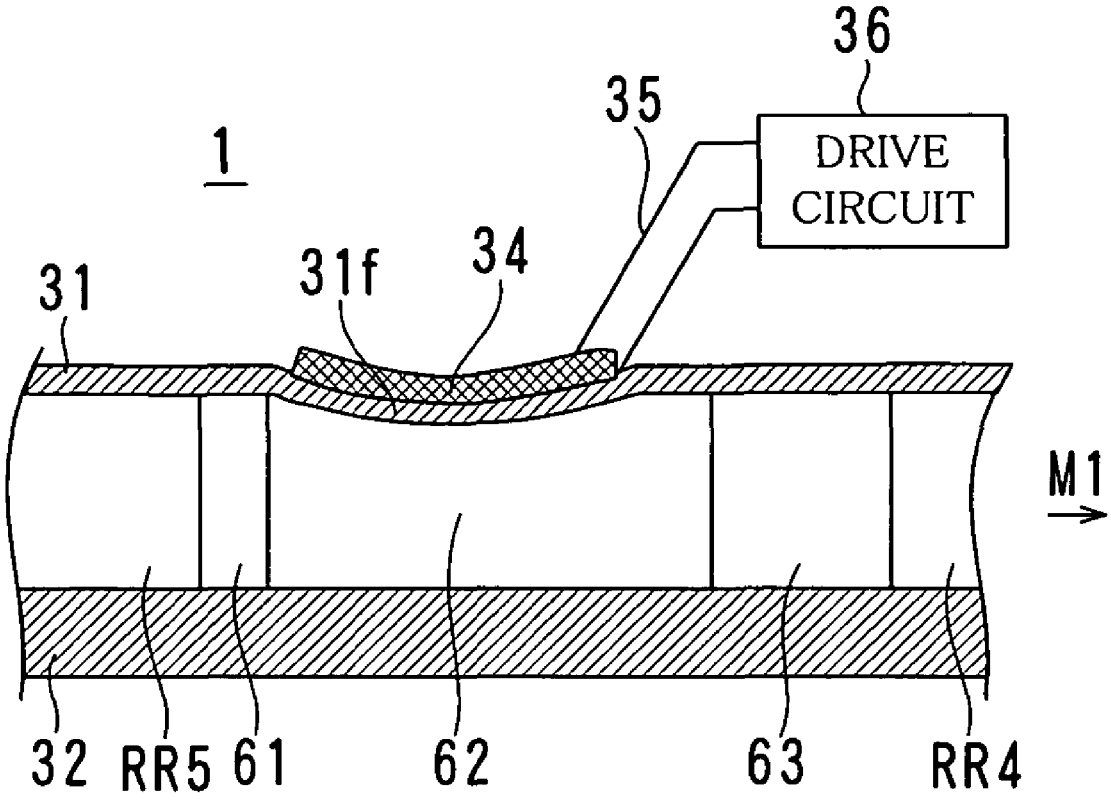
FIG. 4 is a front sectional view of the micropump.
Figure 5A:
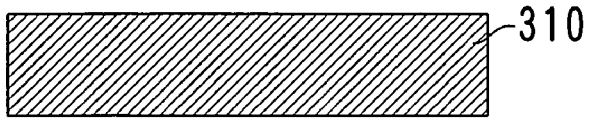
FIGS. 5A-5H show an example of a manufacturing process of the micropump.
Figure 5B:
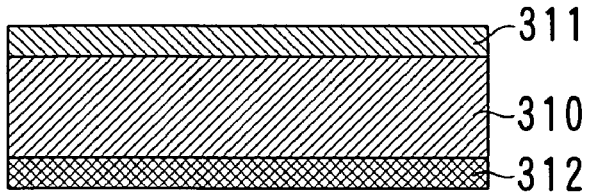
Figure 5C:
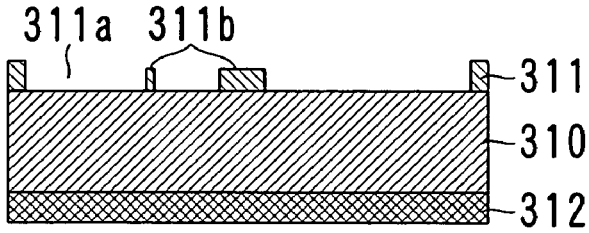
Figure 5D:
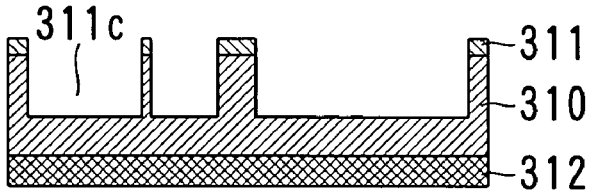
Figure 5E:
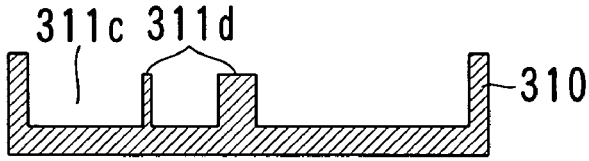
Figure 5F:
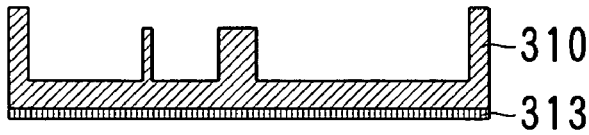
Figure 5G:
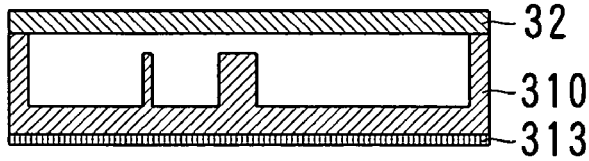
Figure 5H:
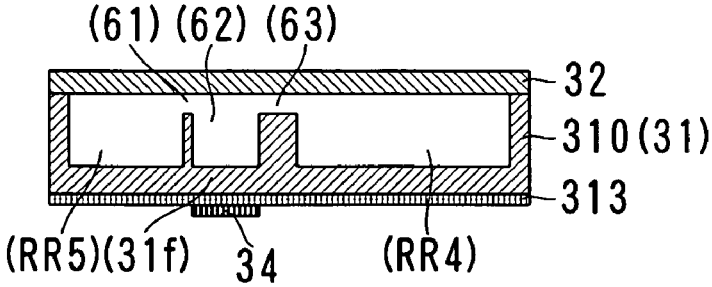
Figure 6A:
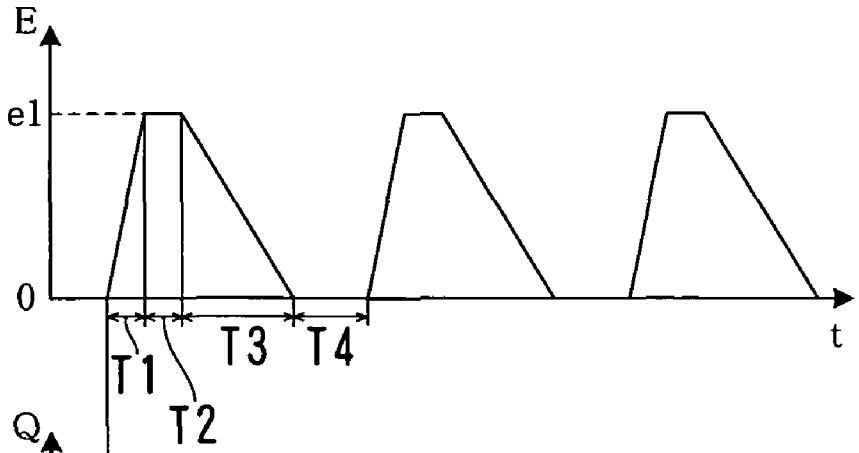
FIGS. 6A and 6B show an example of waveforms of a drive voltage of a piezoelectric element.
Figure 6B:
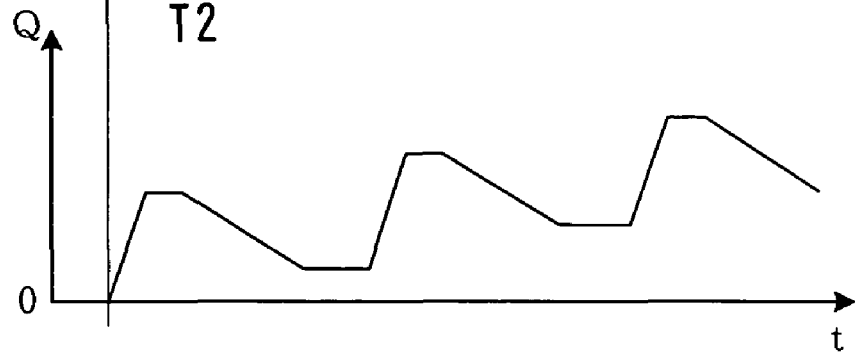
Figure 7A:
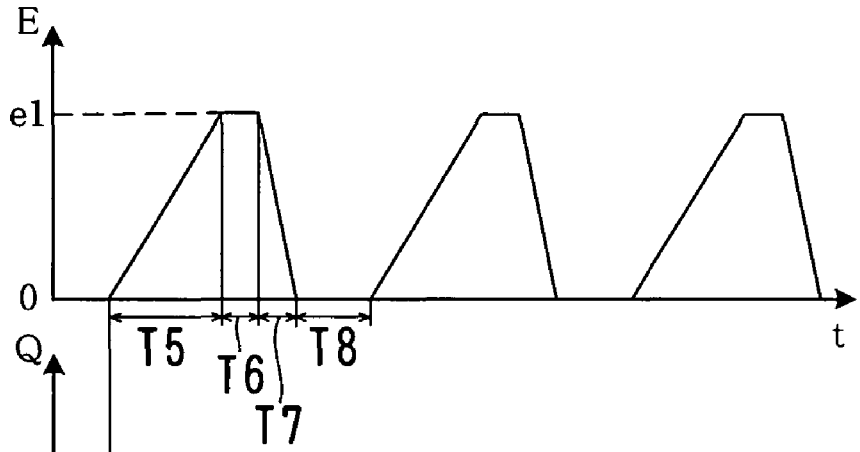
FIGS. 7A and 7B show an example of waveforms of a drive voltage of a piezoelectric element.
Figure 7B:
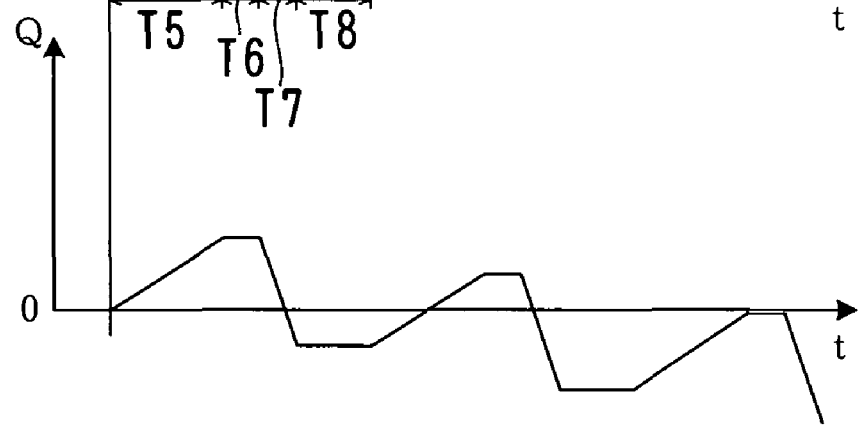

FIG. 1 is a front view of a microfluidic device 1 according to a first embodiment of the present invention, FIG. 2 is an exploded perspective view of a structure of the microfluidic device 1, FIG. 3 is a plan view of a micropump MP1 shown in FIG. 2, FIG. 4 is a front sectional view of the micropump MP1, FIGS. 5A-5H show an example of a manufacturing process of the micropump MP1, FIGS. 6A and 6B as well as FIGS. 7A and 7B show examples of waveforms of a drive voltage of a piezoelectric element.

Referring to FIGS. 1 and 2, the microfluidic device 1 includes two chips removably attached to each other. One of the two chips is a chip CS for liquid transport on which the micropump MP1 is mounted, while the other is a chip CR for process into which a reagent (a specimen liquid) is injected for a PCR reaction.

The liquid transport chip CS includes a pump chip 11 and a glass substrate 12.

The pump chip 11 has a structure in which the micropump MP1, liquid chambers RE1-RE4, gas chambers RK2-RK3, connection chambers RS1-RS2 and channels RR1-RR8 for connecting therebetween are formed on a surface of a silicon substrate 31. The inner circumferential surface of each of the channels RR1-RR8 is treated with an oil repellent.

The liquid chambers RE1-RE4 are equal to the gas chambers RK2-RK3 in volume. Further, the liquid chambers RE1-RE4 may be equal to the gas chambers RK2-RK3 in diameter and depth. Each of the liquid chambers RE1-RE4 and each of the gas chambers RK2-RK3 have, for example, a diameter of 3.5 mm, a depth of 0.2 mm and a volume of approximately 2 μl. As long as the connection chambers RS1-RS2 have dimensions needed to be in communication with connection holes AN1-AN2, which are described later, formed on the glass substrate 12, the dimensions are sufficient. The channels RR1-RR8 serve to distribute (run) a liquid or a gas in areas provided among the chambers. Each of the channels RR1-RR8 has, for example, a width of 100 μm and a depth of 100 μm.

Referring to FIG. 3, the micropump MP1 includes a chamber 62 functioning as a pump chamber and openings 61 and 63 that are formed at an inlet and an outlet of the chamber 62 respectively. The openings 61 and 63 connect to the channels RR5 and RR4 respectively. The openings 61 and 63 have width dimensions or effective sectional areas smaller than that of the channel RR5 or the channel RR4, and the openings 61 and 63 differ from each other in effective length. The differences in shape and dimensions allow the micropump MP1 to operate as a micropump. The details are described later.

With reference to FIG. 4, the micropump MP1 is fabricated as follows. A photolithography process is used to form grooves or cavities on the silicon substrate 31, the grooves or cavities eventually structuring the chamber 62, the openings 61 and 63, the channels RR5 and RR4 or others. Then, a glass substrate 32 as a bottom plate or a top plate is bonded to a lower surface or an upper surface of the silicon substrate 31.

For example, a silicon substrate 310 is prepared as shown in FIG. 5A. A silicon wafer having a thickness of 200 μm, for example, is used as the silicon substrate 310. Then, oxide films 311 and 312 are formed on the upper and lower surfaces of the silicon substrate 310 respectively, as shown in FIG. 5B. Each of the oxide films 311 and 312 is coated by thermal oxidation so as to have a thickness of 1.7 μm. After that, the upper surface is coated with a resist, exposure and development of a predetermined mask pattern is performed, and the oxide film 311 is etched. Then, the resist on the upper surface is peeled off, and subsequently, coating of a resist, exposure, development and etching are performed again. In this way, portions 311*a* where the oxide film 311 is completely removed and portions 311*b* where the oxide film 311 is partly removed in the thickness direction are formed as shown in FIG. 5C. In the resist coating process, for example, a resist such as OFPR800 is used to perform spin coating with a spin coater. The resist film has a thickness of, for example, 1 μm. An aligner is employed for exposure and a developer is used for development. For instance, RIE is used for etching of the oxide film. A stripper such as a mixture of sulfuric acid and hydrogen peroxide is used in order to separate the resist.

Next, before completing silicon etching of the upper surface, the oxide film 311 is completely removed by the etching process. Then, silicon etching is performed again to form portions 311*c* where the silicon substrate 310 is etched by 170 μm in depth and portions 311*d* where the silicon substrate 310 is etched by 250 μm in depth, as shown in FIGS. 5D and 5E. For the silicon etching, for example, Inductively Coupled Plasma (ICP) is used.

As shown in FIG. 5E, BHF is used, for example, to remove the oxide film 311 on the upper surface completely. Then, an electrode film 313 such as an ITO film is formed on the lower surface of the silicon substrate 310 as shown in FIG. 5F. Subsequently, a glass plate 32 is attached to the upper surface of the silicon substrate 310 as shown in FIG. 5G. For the attachment of the glass plate 32, anodic bonding is performed under the condition of 1200 V and 400° C. Lastly, as shown in FIG. 5H, a piezoelectric element 34 such as PZT (lead zirconate titanate) ceramics is adhered to a portion of a diaphragm of the chamber 17 for attachment.

Note that, in FIG. 5H, reference numerals in parentheses show portions corresponding to the portions denoted by the same reference numerals in FIG. 4. Referring to FIG. 4, the openings 61 and 63 are formed by reducing widths of grooves (the vertical direction with respect to the paper surface) compared to the channels RR5 and RR4 to serve as openings. Referring to FIG. 5H, the openings 61 and 63 are formed by reducing depths of grooves (the vertical direction in a plan view) compared to the channels RR5 and RR4 to serve as openings. Further, note that the upper side and the lower side shown in FIG. 4 are turned upside down in FIG. 5H.

The micropump MP1 can be fabricated in the method described above. Instead, it is also possible to fabricate the micropump MP1 by conventionally known methods or other methods, or by the use of other materials.

The glass substrate 12 has a structure in which the connection holes AN1-AN2 penetrating a glass plate 32 and heating portions KN1-KN3 are formed on the glass plate 32.

The connection holes AN1-AN2 are brought into communication with the connection chambers RS1-RS2 respectively, when the pump chip 11 is bonded to the glass plate 32. The heating portions KN1-KN3 can be structures using various heating elements, such as heaters using nichrome wires or others, and structures in which resistance values are controlled using ITO films with different widths.

The heating portions KN1-KN3 are supplied with currents from a heating drive portion (not shown). The heating portions KN1-KN3 are heated and controlled so as to be a temperature corresponding to denaturation of a PCR reaction, a temperature corresponding to extension thereof and a temperature corresponding to annealing thereof, respectively. For instance, the heating portion KN1 has a temperature of 95° C., the heating portion KN2 has a temperature of 75° C. and the heating portion KN3 has a temperature of 55° C. However, since the temperatures are taken as one example, it is not necessarily that the heating portions KN1-KN3 should have these temperatures, respectively. The arrangement order of the heating portions KN1-KN3 can also be modified.

To cite instances of dimensions, the pump chip 11 has outside dimensions of approximately 30 mm×30 mm×0.5 mm, the glass substrate 12 has outside dimensions of approximately 50 mm×30 mm×1 mm and the entire liquid transport chip CS has outside dimensions of about 50 mm×30 mm×1.5 mm. These dimensions and shapes are one example and other various dimensions and shapes can be adopted.

Hereinafter, the operation of the micropump MP1 is described.

A drive circuit 36 shown in FIG. 4 is used to apply a voltage having a waveform shown in FIG. 6A or FIG. 7A to the piezoelectric elements 34, so that a diaphragm 31*f* that is a silicon thin film and the piezoelectric elements 34 perform flexion deformity in unimorph mode. The flexion deformity is used for increase or decrease of the volume of the chamber 62.

As discussed above, the openings 61 and 63 have effective sectional areas smaller than those of the channels RR5 and RR4. The opening 63 is so set that the opening 63 has a lower rate of change in channel resistance when pressure inside the chamber 62 is raised or lowered, compared to the opening 61.

More specifically, the opening 61 has low channel resistance when the differential pressure between the both ends thereof is close to zero. As the differential pressure in the opening 61 increases, the channel resistance thereof increases. Stated differently, pressure dependence is large. Compared to the case of the opening 61, the opening 63 has higher channel resistance when the differential pressure is close to zero. However, the opening 63 has little pressure dependence. Even if the differential pressure in the opening 63 increases, the channel resistance thereof does not change significantly. When the differential pressure is large, the opening 63 has channel resistance lower than the opening 61 has.

The characteristics of channel resistance mentioned above can be obtained by any of the following: 1. Bringing a liquid flowing through a channel to be any one of laminar flow and turbulent flow depending on the magnitude of the differential pressure. 2. Bringing the liquid to be laminar flow constantly regardless of the differential pressure. More particularly, for example, the former can be realized by providing the opening 61 in the form of an orifice-like opening having a short channel length, while the latter can be realized by providing the opening 63 in the form of a nozzle-like opening having a long channel length. In this way, the characteristics of channel resistance discussed above can be realized.

The channel resistance characteristics of the opening 61 and the opening 63 are used to produce pressure in the chamber 62 and a rate of change in pressure is controlled, so that a pumping action in a discharge process and a suction process respectively, such as discharging or sucking more fluids to/from either one of the openings 61 and 63 that has lower channel resistance can be realized.

More specifically, the pressure in the chamber 62 is raised and the rate of change in pressure is made large, resulting in the high differential pressure. Accordingly, the channel resistance of the opening 61 is higher than that of the opening 63, so that most fluids within the chamber 62 are discharged from the opening 63 (discharge process). The pressure in the chamber 62 is lowered and the rate of change in pressure is made small, which keeps the differential pressure low. Accordingly, the channel resistance of the opening 61 is lower than that of the opening 63, so that more liquids flow from the opening 61 into the chamber 62 (suction process).

To the contrary, the pressure in the chamber 62 is raised and the rate of change in pressure is made small, which keeps the differential pressure low. Accordingly, the channel resistance of the opening 61 is lower than that of the opening 63, so that more fluids in the chamber 62 are discharged from the opening 61 (discharge process). The pressure in the chamber 62 is lowered and the rate of change in pressure is made large, resulting in the high differential pressure. Accordingly, the channel resistance of the opening 61 is higher than that of the opening 63, so that more fluids flow from the opening 63 into the chamber 62 (suction process).

The drive voltage supplied to the piezoelectric element 34 is controlled and the amount and timing of deformation of the diaphragm are controlled, which realizes pressure control of the chamber 62 mentioned above. For example, a drive voltage having a waveform shown in FIG. 6A is applied to the piezoelectric element 34, leading to discharge to the channel RR4 side. A drive voltage having a waveform shown in FIG. 7A is applied to the piezoelectric element 34, leading to discharge to the channel RR5 side.

Referring to FIGS. 6A and 6B as well as FIGS. 7A and 7B, a maximum voltage e1 to be applied to the piezoelectric element 34 ranges approximately from several volts to several tens of volts and is about 100 volts at the maximum. Time T1 and T7 are on the order of 20 μs, time T2 and T6 are from approximately 0 to several microseconds and time T3 and T5 are about 60 μs. Time T4 and T8 may be zero. Frequency of the drive voltage is approximately 11 KHz. With drive voltages shown in FIGS. 6A and 7A, the channel RR4 provides flow rates, for example, illustrated in FIGS. 6B and 7B. Flow rate curves in FIGS. 6B and 7B schematically show flow rates obtained by a pumping action. In practice, inertial oscillation of a fluid is added to the flow rate curves. Accordingly, curves in which oscillation components are added to the flow rate curves shown in FIGS. 6B and 7B show actual flow rates obtained by an actual pumping action.

Each of the openings 61 and 63 in the present embodiment is structured by a single opening. Instead, a group of openings can be used in which plural openings are arranged in parallel. The use of the group enables pressure dependence to be further lowered. Accordingly, when the group of openings is substituted for the opening, especially for the opening 63, the flow rate is increased and the flow rate efficiency is improved.

Referring back to FIGS. 1 and 2, the process chip CR includes a channel chip 13 and a resin substrate 14.

The channel chip 13 has a structure in which process chambers RY1-RY3, a gas chamber RK1, gas chambers RK4-RK6, a connection chamber RS3, a connection hole AN3 and channels RR9-RR16 for connecting therebetween are formed on a surface of a resin plate 41 made of a synthetic resin. The inner circumferential surface of each of the channels RR9-RR16 is treated with a water repellent.

The process chambers RY1-RY3 are equal to the gas chambers RK1 and RK4-RK6 in volume. Further, the process chambers RY1-RY3 and the gas chambers RK1 and RK4-RK6 are respectively equal to the corresponding chambers formed on the pump chip 11 in volume. Accordingly, the three process chambers RY1-RY3 have the same volume. In addition, each of the process chambers RY1-RY3 is set so as to have a volume greater than a volume of a reagent that is injected at a time. The following mathematical expression shows the relationship among volumes Vy1-Vy3 of the process chambers RY1-RY3.

$$Vy1=Vy2=Vy3=Vy>Vk$$

where Vy1-Vy3 denote volumes of the process chambers RY1-RY3 respectively and Vk denotes a reagent amount used in one test. The establishment of the relationship prevents a reagent from extending over two of the process chambers RY, i.e., from extending over two temperature areas. Thus, it is possible to securely retain a reagent in one temperature area for an accurate test.

The process chambers RY1-RY3 are positioned so as to correspond to the positions of the heating portions KN1-KN3 respectively when the process chip CR is attached to the liquid transport chip CS. More specifically, the heating portions KN1-KN3 heat reagents filled in the process chambers RY1-RY3 respectively.

The whole or a part of the process chambers RY1-RY3 and the vicinity thereof are transparent. Each of the process chambers RY1-RY3 has a shape that enables a reagent filled in the process chamber RY2 to be measured or observed optically, for example when the process chamber RY2 is set to an extension temperature (75° C., for example).

The connection hole AN3 has the same size as the connection hole AN2. When the process chip CR is attached to the liquid transport chip CS, the position of the connection hole AN3 matches the position of the connection hole AN2, so that the connection hole AN3 and the connection hole AN2 are in communication with each other.

The resin substrate 14 has a connection hole AN4 and a fill port AT1 formed on a resin plate 42 made of a synthetic resin. The position of the connection hole AN4 matches the position of the connection chamber RS3 when the resin substrate 14 is bonded to the channel chip 13, so that the connection hole AN4 and the connection chamber RS3 are in communication with each other. The fill port AT1 is used for injecting a reagent into the process chambers RY1-RY3. The fill port AT1 has a diameter of, for example, 0.5-2 mm, preferably on the order of 1 mm. The position of the fill port AT1 matches the position of the process chamber RY1 and a reagent injected from the fill port AT1 is supplied to the process chamber RY1 directly.

The resin substrate 14 and the channel chip 13 are aligned with each other and are joined to each other by, for example, laser fusion or other methods. The process chip CR clings to the liquid transport chip CS. Further, the process chip CR has a packing (not shown) and thereby channels are sealed.

Next, a description is provided of operation of the microfluidic device 1 structured as discussed above.

Figure 8:
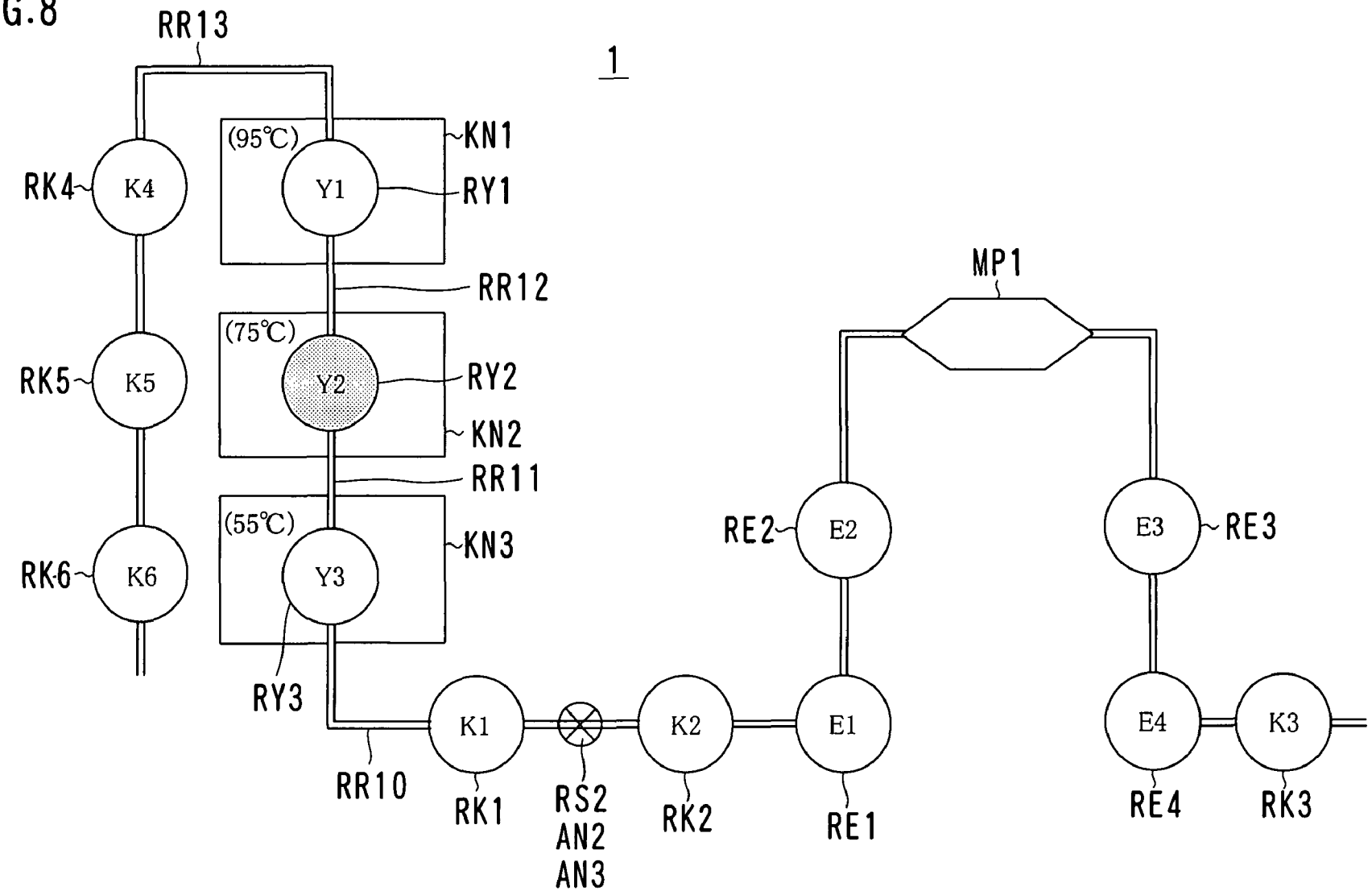
FIG. 8 is a plan view showing a structure of a microfluidic system according to the first embodiment.

FIG. 8 shows a connection state of the chambers in the microfluidic device 1.

Referring to FIG. 8, in an initial state before starting a test, the inside of the micropump MP1, i.e., the inside of the pump chamber, the liquid chambers RE1-RE2 and the channels RR therebetween are filled with a drive solution such as a mineral oil. The gas chamber RK6 is filled with a sealing solution such as a mineral oil. The mineral oil prevents a reagent (a specimen liquid) from evaporating and also serves to prevent contamination.

A reagent is injected from the fill port AT1 to be supplied to the process chamber RY1. For example, approximately 2 μm of a specimen liquid for which gene amplification is intended is injected. Then, a plug FT1 is put in the fill port AT1 for closing the same. Note that, after completing a test, the plug FT1 can be pulled out and the reagent can be removed from the fill port AT1.

At the time point when the plug FT1 is put in the fill port AT1, a gas with a pressure equivalent to an atmosphere pressure is present in each of the gas chambers RK1-RK5, the liquid chambers RE3-RE4 and the process chambers RY2-RY3. As the gas, a nitrogen gas, air or various other gases are used. The gas present in each of the gas chambers RK1, RK2, RK4 and RK5 and the process chambers RY2-RY3 is sealed by the sealing solution or the drive solution. In addition, no reagent in the process chamber RY1 comes into contact with the sealing solution in the gas chamber RK6 and the drive solution in the liquid chamber RE1. In other words, the gas is present in areas among the process chamber RY1, the gas chamber RK6 and the liquid chamber RE1.

The drive circuit 36 is used to drive the micropump MP1 until, for example, the liquid chamber RE3 is filled with the drive solution. This drive moves the drive solution contained in the liquid chamber RE1 to the liquid chamber RE2 and moves the drive solution contained in the liquid chamber RE2 and the drive solution in the micropump MP1 to the micropump MP1 and the liquid chamber RE3 respectively. Stated differently, the drive solution moves by one liquid chamber RE.

Then, along with the movement of the drive solution, the reagent contained in the process chamber RY1 moves through the gases contained in the gas chambers RK1-RK2 and in the process chambers RY2-RY3 and all the reagent contained in the process chamber RY1 is supplied to the process chamber RY2. The sealing solution contained in the gas chamber RK6 is supplied to the gas chamber RK5. In such a case, amount Vs of liquid transport using the micropump MP1 is derived from the following equation.

$$Vs=Vy+Vr$$

where Vr represents a volume of one channel RR neighboring the process chamber RY. Accordingly, each of the channels RR3-RR6, RR11, RR12, RR14 and RR15 is preferably formed so as to have the same volume. Especially, it is necessary to equalize the volumes of the channels RR11 and RR12, each of which is directly connected between the process chambers RY.

Then, the micropump MP1 is further driven, until, for example, the liquid chamber RE4 is filled with the drive solution contained in the liquid chamber RE3. This drive moves the reagent contained in the process chamber RY2 to the process chamber RY3 through the gas, similar to the foregoing case.

The control of the drive amount of the micropump MP1 enables the reagent contained in the process chamber RY1 to move to the process chamber RY3 at one time.

In the case where the liquid transport direction by the micropump MP1 is reversed to move the drive solution to the direction opposite to the above-mentioned direction, the reagent contained in the process chamber RY3 can be moved to the process chamber RY2 or the process chamber RY1.

More specifically, the control of the drive amount and of the drive direction of the micropump MP1 permits the reagent to reciprocate between the process chambers RY1-RY3. The reagent is contained in a predetermined process chamber RY and the state is maintained for a predetermined period of time. This repetition enables the reagent to be subjected to a cycle of a temperature process necessary for the PCR method. Thereby, gene amplification is performed.

In the meanwhile, no sealing solution and no drive solution leak out. No reagent comes into contact with the sealing solution and the drive solution directly. Accordingly, diffusion or mixing of a reagent or a liquid does not occur. Further, the provision of the gas chambers RK1-RK3 prevents the drive solution from getting in another chip or from outflowing from a chip, even if the drive solution moves excessively. Accordingly, each of the chips or of the chambers is not contaminated by other liquids.

The reagent is made to reciprocate between the process chambers RY1-RY3, for example, 20 through 30 times and, the reagent is made to remain in the process chamber RY2 ultimately. The reagent retained in the process chamber RY2 is optically measured or observed with an appropriate measurement device or sensor. In this way, for example, an amplification state of a gene under an extension temperature can be measured. This measurement can be made for one cycle or for every plural cycles. Accordingly, an amplification state of a gene can be easily measured in real time, i.e., a real-time PCR can be realized and the result thereof can be obtained without delay.

Since it is sufficient that the reagent has an amount enough to fill one process chamber RY, a needed amount of the reagent can be substantially reduced compared to conventional cases.

All materials required for a test of a reagent are incorporated into the microfluidic device 1, the entire structure thereof is simple and significant downsizing thereof can be attempted. Since channels where a reagent or the like moves are short and sectional areas thereof are small, there are no wasted volumes and responsiveness is good. Accordingly, positioning after movement of a reagent can be accurately performed with a high degree of precision. Since the microfluidic device 1 also has a good compliant property with reagent temperature, a reaction time can be shortened.

The liquid transport chip CS is removably attached to the process chip CR. Accordingly, replacement of process chips allows for tests using different reagents or under different conditions many times using the same liquid transport chip CS. Since the process chip CR is inexpensive, the process chip CR is disposable. This eliminates the need for washing the process chip CR and the possibility of mix of other reagents accidentally. Further, the process chip CR is provided with the gas chamber RK1 which serves as a buffer when unforeseen circumstances occur, preventing the reagent from getting in the liquid transport chip CS and the liquid transport chip CS from being contaminated.

The micropump MP1 has a property that liquid transport characteristics change depending on a viscosity of a liquid to be transported. However, only the drive solution is supplied inside the micropump MP1 and only one kind of a liquid is transported by the micropump MP1. Accordingly, physical properties such as a viscosity do not change and liquid transport characteristics are always constant. This allows for stable liquid transport of any kind of reagents and an accurate test.

Additionally, since the inner circumferential surface of each of the channels RR1-RR8 and RR9-RR16 is treated with an oil repellent or a water repellent, a liquid can be stopped securely for each chamber, leading to the more accurate liquid transport compared to conventional cases.

In the present embodiment, each of the channels RR1-RR8 is treated with an oil repellent because a mineral oil is used as the drive solution. If the drive solution is of a water type, each of the channels RR1-RR8 may be treated with a water repellent.

According to the microfluidic device 1 described above, stable liquid transport can be realized by the micropump MP1. Further accurate liquid transport with a high degree of precision can be realized by the following method.

Figure 9:
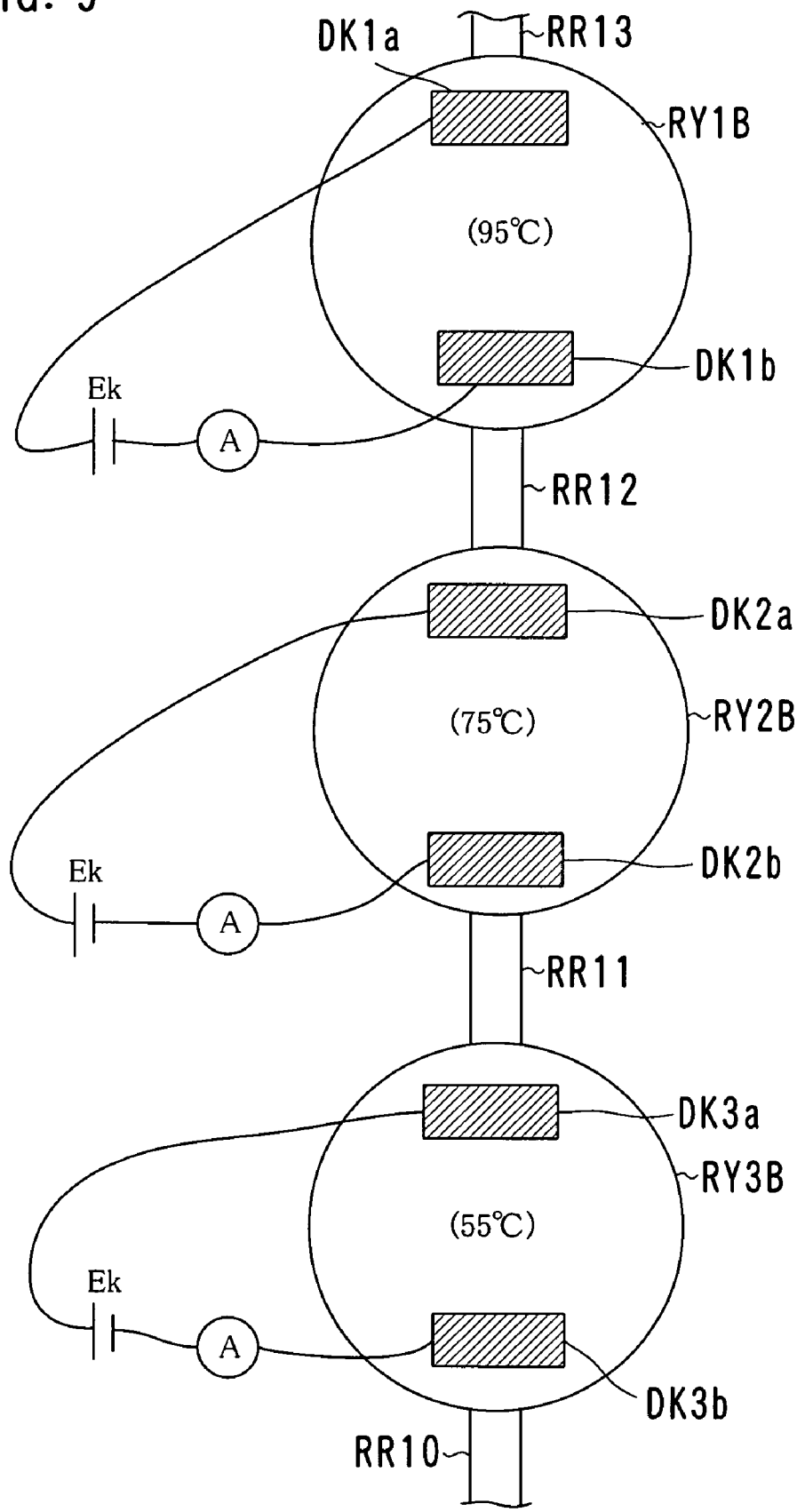
FIG. 9 is a plan view showing process chambers in a channel chip according to another example.

FIG. 9 is a plan view showing process chambers RY1B-RY3B in the channel chip 13 according to another example.

As shown in FIG. 9, inside each of the process chambers RY1B-RY3B, two detection electrodes DK1*a* and DK1*b*, DK2*a* and DK2*b*, or DK3*a* and DK3*b* are provided in the vicinity of an inlet and an outlet of each of the process chambers RY1B-RY3B. The detection electrodes DK are formed by patterning platinum or titanium. The detection electrodes DK may be formed by print on the surface of the resin substrate 14.

When a voltage Ek is applied between the two respective detection electrodes and a reagent remains in each of the process chambers RY1B-RY3B so as to wet the two detection electrodes DK therein, a current Ik flows between the two respective detection electrodes DK, and then, the current Ik is detected. In other words, the current Ik flowing between the two detection electrodes DK or the magnitude of the current Ik is detected, and thereby, it is judged that the reagent is supplied to the process chamber RY. Detection signals from the detection electrodes DK are fed back to the drive circuit 36. For example, the micropump MP1 is stopped by the detection electrodes DK. Thus, liquid transport among the process chambers can be performed even more accurately.

Note that the voltage Ek in FIG. 9 is depicted as a principle and, in practice, an electronic component or an IC circuit is used to detect a microcurrent or others. Further, it is possible to judge whether the reagent is supplied to the process chamber RY by optical detection of the reagent in the process chamber RY, instead of by provision of the detection electrodes DK.

A sealing solution moves among the gas chambers RK4-RK6 to prevent atmospheric contamination. The sealing solution, however, is omitted because influences of the atmospheric contamination on the liquid transport chip are low due to low heating temperature. Nevertheless, when measures for the atmospheric contamination are needed, it is possible to provide a structure as same as the gas chambers RK4-RK5, the channel RR15 and the gas chamber RK6, the structure being substitute for the gas chamber RK1, between the channels RR9 and RR10 and to supply the structure with the sealing solution.

Figure 10:
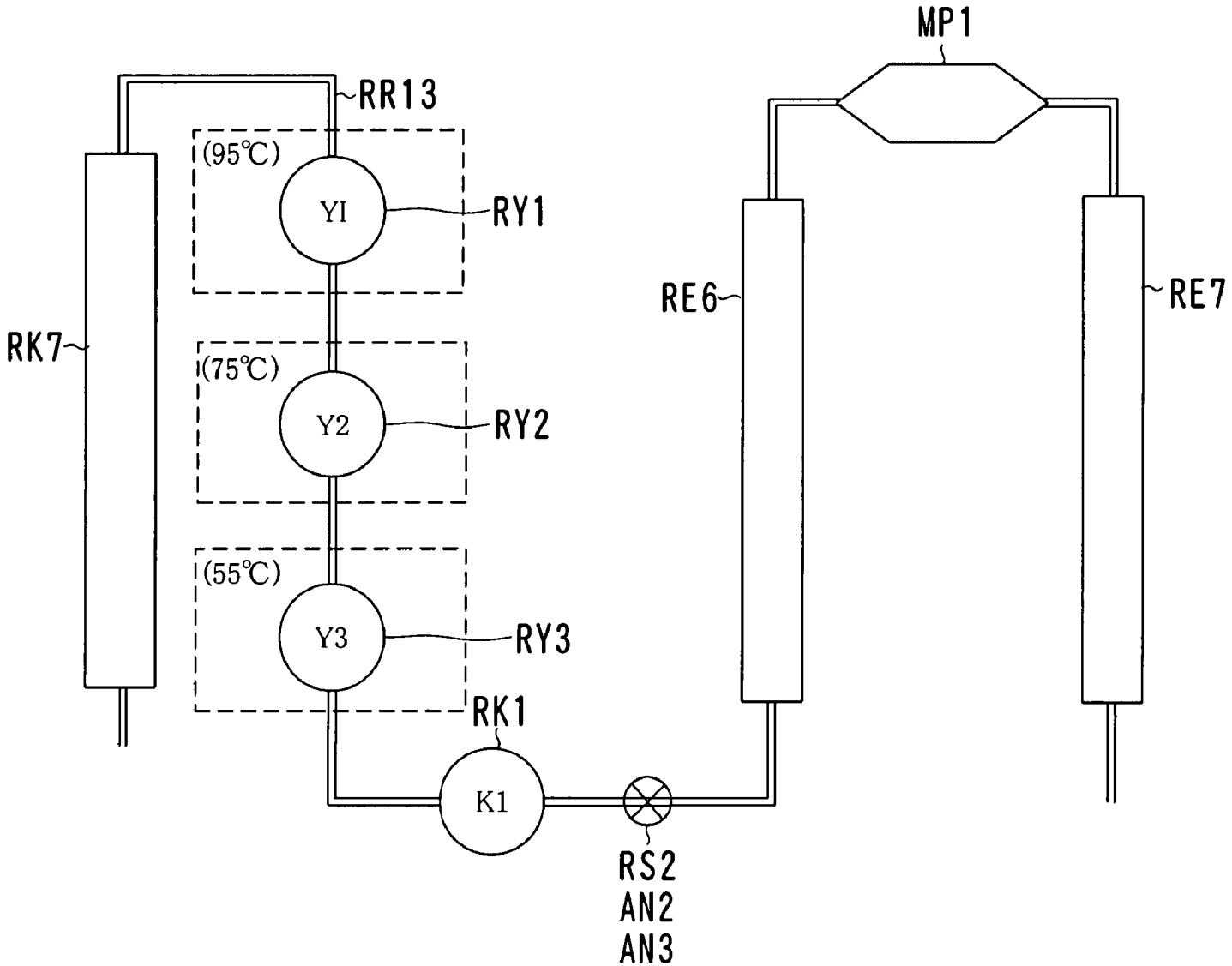
FIG. 10 is a diagram showing a modification of a structure of gas chambers and liquid chambers.

FIG. 10 is a diagram showing a modification of a structure of the gas chambers RK and the liquid chambers RE.

As shown in FIG. 10, one large unseparated gas chamber RK 7 is provided instead of the gas chambers RK4-RK6 shown in FIG. 8. Similarly, one large liquid chamber RE6 is provided instead of the gas chambers RK1-RK2 and the liquid chamber RE2 and, one large liquid chamber RE7 is provided instead of the liquid chambers RE3-RE4 and the gas chamber RK3. Under such a structure, a sensor using the detection electrodes DK shown in FIG. 9 or others may be used to control a liquid transport amount or timing.

Next, a description is provided of a structure of the gas chambers RK and the liquid chambers RE according to another example.

Figure 11:
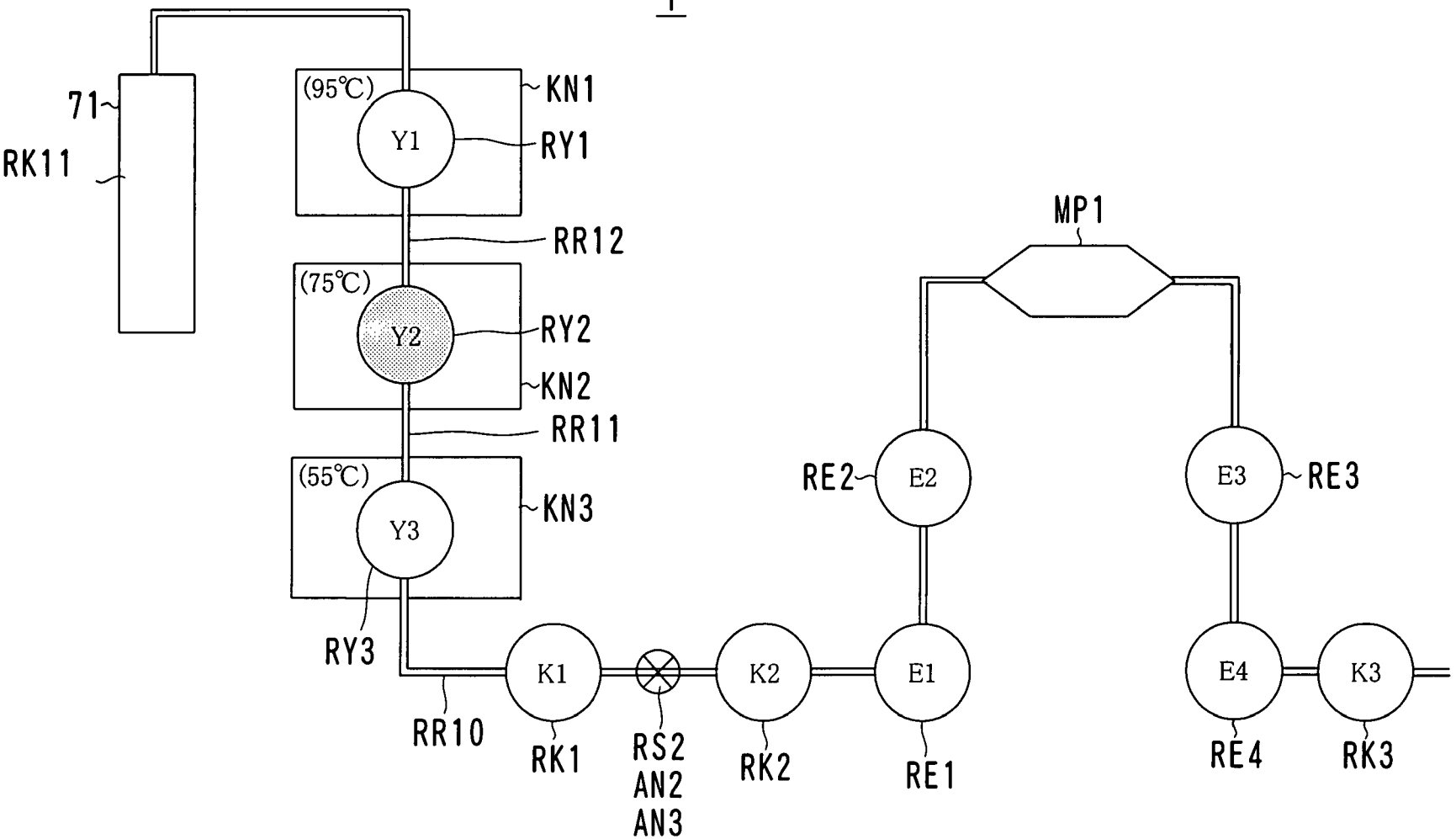
FIG. 11 is a diagram of a microfluidic device in which gas chambers according to another example are used.
Figure 12:
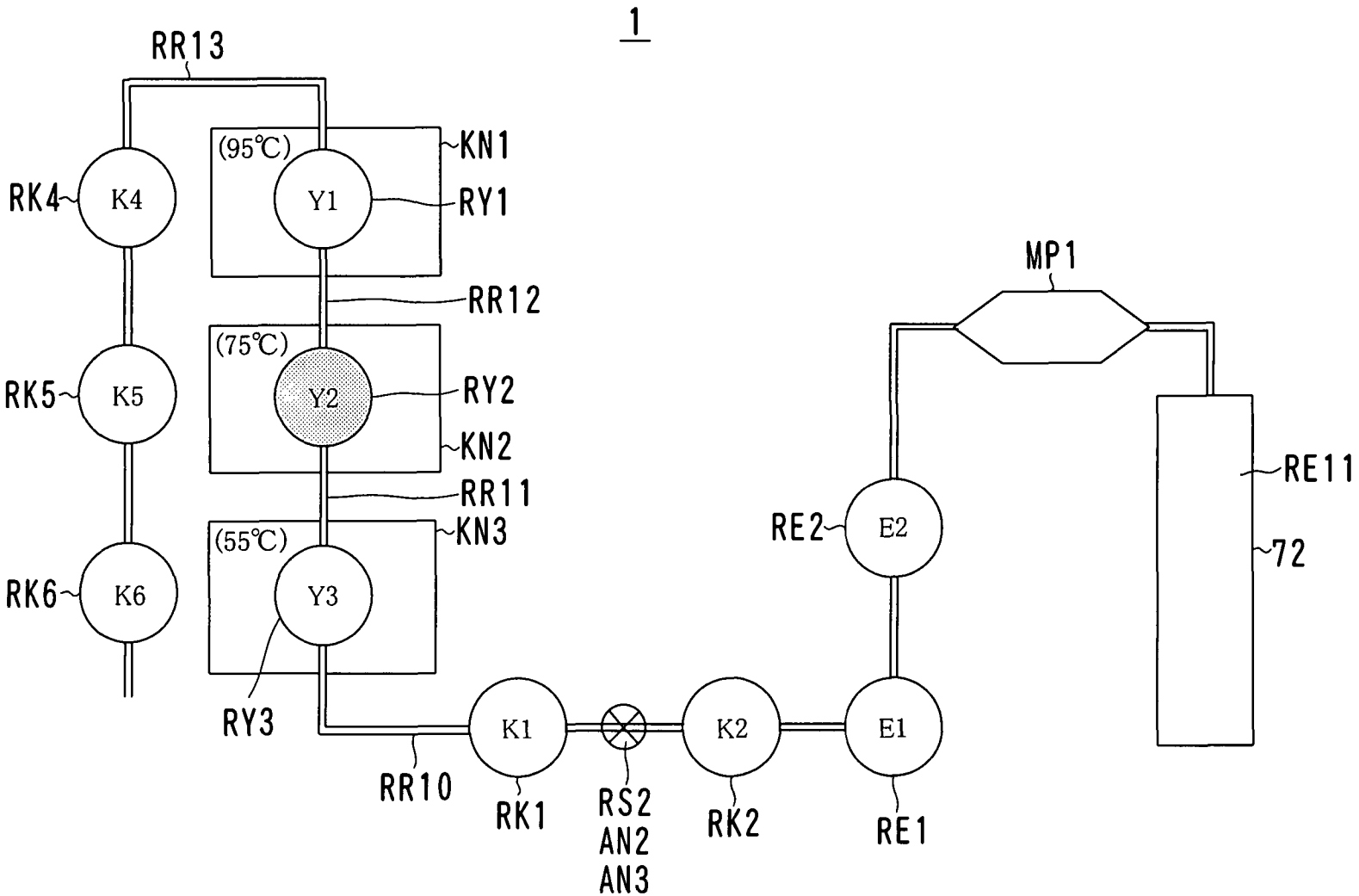
FIG. 12 is a diagram of a microfluidic device in which liquid chambers according to another example are used.

FIG. 11 is a diagram showing a connection state of chambers in the microfluidic device 1 in which a gas chamber RK11 in another example is used and FIG. 12 is a diagram showing a connection state of chambers in the microfluidic device 1 in which a liquid chamber RE11 in another example is used.

Referring to FIG. 11, the gas chamber RK11 is structured by a bag 71 made of a soft film-like material such as a resin film. A plurality of corrugations is formed in the bag 71 that has little resistance to gas moving in and gas moving out. The volume of the bag 71 expands depending on an amount of a gas that has moved therein. The bag 71 contracts when a gas moves out thereof. The gas chamber RK11, however, is cut off from outside air. Stated differently, the bag 71 serves to trap a gas within the gas chamber RK11 and to maintain a pressure in the gas chamber RK11 equal to an atmosphere pressure.

Accordingly, in the case where a reagent in the process chamber RY1 moves to the process chamber RY2, a gas in the gas chamber RK11 is supplied to the process chamber RY1. When the reagent further moves to the process chamber RY3, the gas is supplied to the process chambers RY1 and RY2. When the reagent returns to the process chamber RY1, the gas returns to the gas chamber RK11.

Such a bag 71 may be made of a soft rubber film or of an accordion-like material. Further, instead of the bag 71, a constituent element in which a resin film or a rubber film flexibly covers an opening of a concave portion formed on a chip may be used.

Referring to FIG. 12, the liquid chamber RE11 is structured by a bag 72 made of a soft film-like material such as a resin film. A plurality of corrugations is formed in the bag 72 that has little resistance to liquid moving in and liquid moving out. The volume of the bag 72 expands depending on an amount of a liquid that has moved therein. The bag 72 contracts when a liquid moves out thereof. The liquid chamber RE11, however, is cut off from outside air. Stated differently, the bag 72 serves to trap a liquid within the liquid chamber RE11 and to maintain a pressure in the liquid chamber RE11 equal to an atmosphere pressure.

Accordingly, a drive solution discharged from the micropump MP1 is reserved in the liquid chamber RE11. In the case where the drive solution is discharged to the liquid chamber RE2 side by the micropump MP1, the drive solution is supplied from the liquid chamber RE11. In short, the liquid chamber RE11 functions as a tank of the drive solution.

Similarly to the case of the bag 71 as mentioned above, such a bag 72 may be made of a soft rubber film. Further, instead of the bag 72, a constituent element in which a resin film or a rubber film flexibly covers an opening of a concave portion formed on a chip may be used.

Further, the bag 71 can be used as the gas chamber RK11 and the bag 72 can be used as the liquid chamber RE11, i.e., the bag 71 and the bag 72 can be used in the same microfluidic device 1.

In the case where dirt or bubbles enter the chip for some reason, the drive solution is discharged from the connection holes AN1-AN2, so that the dirt or the bubbles can be discharged together with the drive solution, leading to the recovery to the normal state with ease.

In the present embodiment, the description is provided of an example in which the microfluidic device 1 is structured as a device for conducting a test or an examination by the PCR method. In addition to the example, it is possible to use the present embodiment in order to move or transport various intended liquids through a gas by filling the micropump MP1 with various drive solutions. The present embodiment can apply to, for example, a biochemical examination, an immunological examination, a genetic test, a chemical synthesis, drug development or an environmental measurement.

Second Embodiment

In the foregoing first embodiment, the three process chambers RY1-RY3 are individually provided corresponding to the three heating portions KN1-KN3 that are separately provided. In a second embodiment, however, a structure is adopted in which a plurality of temperature areas is provided in one chamber having a constant sectional area.

Figure 13:
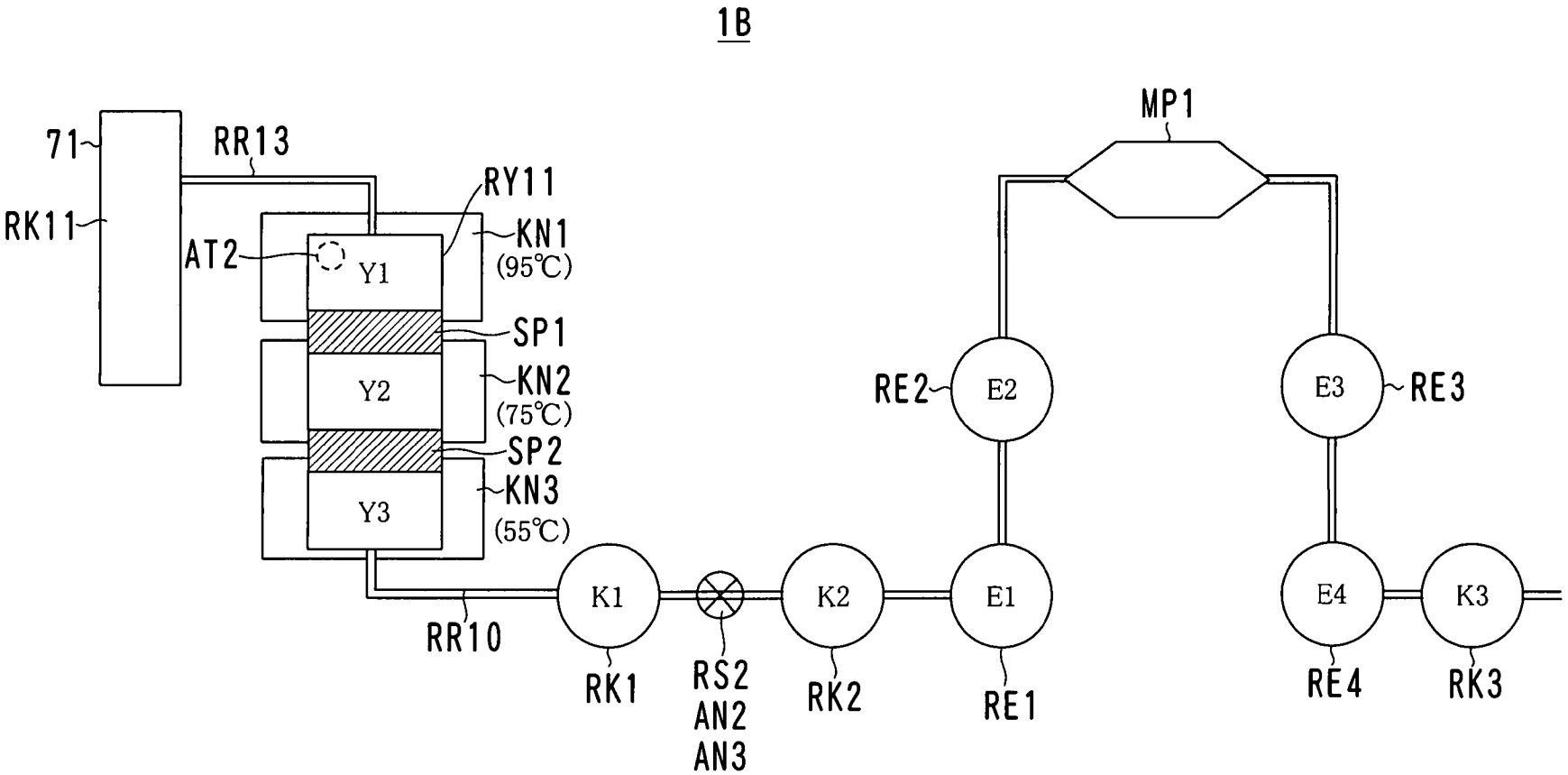
FIG. 13 is a diagram showing a structure of a microfluidic device according to a second embodiment of the present invention.

FIG. 13 is a diagram showing a structure of a microfluidic device 1B according to the second embodiment of the present invention, mainly by a connection state of chambers therein.

As shown in FIG. 13, one process chamber RY11 is provided with extending over three heating portions KN1-KN3. Three chambers Y1-Y3 are provided inside the process chamber RY11. The chambers Y1-Y3 are provided at portions corresponding to the heating portions KN1-KN3, respectively. When being heated, the three chambers Y1-Y3 function as temperature areas of the heating portions KN1-KN3, respectively. Each of the three chambers Y1-Y3 has a volume greater than an amount of a reagent used for one test. The three chambers Y1-Y3 are separated from one another by gap chambers SP1-SP2. Heat insulation in the heating portions KN1-KN3, e.g., slits between heater portions lead to a more preferable result.

The amount of liquid transport using the micropump MP1 at one time is so set that a reagent present in one chamber Y is entirely transported to the neighboring chamber Y. Sensors are provided for detecting the presence of a reagent in the chambers Y1-Y3 or the gap chambers SP1-SP2 and the drive circuit 36 is controlled based on detection signals from the sensors, ensuring that more accurate control can be realized.

Referring to FIG. 13, the upper side of the chamber Y1 included in the process chamber RY11 is provided with a fill port AT2 into which a reagent is injected. The reagent injected from the fill port AT2 is supplied to the chamber Y1 directly. After the injection of the reagent, the fill port AT2 is plugged and sealed.

Since the structures, operations and effects other than the process chamber RY11 of the microfluidic device 1B are similar to the case of the microfluidic device 1 in the first embodiment, descriptions thereof are omitted.

Third Embodiment

In the foregoing first and second embodiments, an end portion of the channel RR1 provided in the micropump MP1 side, i.e., the connection chamber RS1 is completely independent of an end portion of the channel RR16 provided in the process chambers RY side, i.e., the connection chamber RS3. In short, the connection chamber RS1 is not in communication with the connection chamber RS3 in the first and second embodiments. Instead, in a third embodiment, a structure is adopted in which the both end portions are in communication with each other and all the channels RR form one closed loop.

Figure 14:
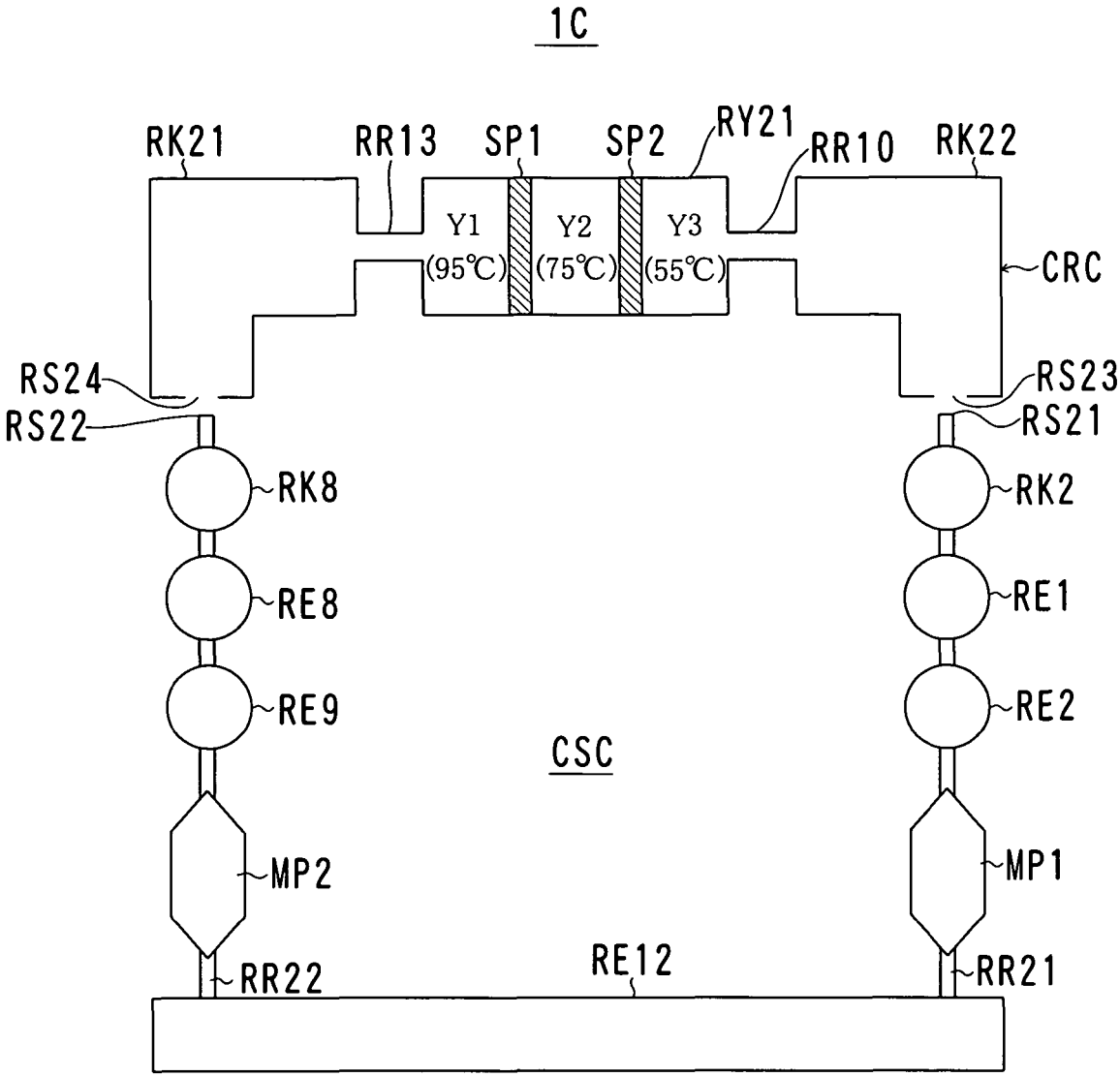
FIG. 14 is a diagram showing a structure of a microfluidic device according to a third embodiment of the present invention.

FIG. 14 is a diagram showing a structure of a microfluidic device 1C according to the third embodiment of the present invention, mainly by a connection state of chambers therein.

As shown in FIG. 14, the microfluidic device 1C includes a liquid transport chip CSC and a process chip CRC.

The liquid transport chip CSC includes two micropumps MP1-MP2, a liquid chamber RE12, a gas chamber RK2, liquid chambers RE1-RE2, a gas chamber RK8, liquid chambers RE8-RE9 and connection chambers RS21-RS22. The liquid chamber RE12, channels RR21-RR22 and the micropumps MP1-MP2 are filled with a drive solution.

The process chip CRC includes a process chamber RY21, gas chambers RK21-RK22 and connection chambers RS23-S24. The process chamber RY21 further includes three chambers Y1-Y3 and gap chambers SP1-SP2 for separating the three chambers Y1-Y3, similar to the case of the process chamber RY11 described in the second embodiment. The chambers Y1-Y3 are provided at portions corresponding to heating portions KN1-KN3, respectively. When being heated, the three chambers Y1-Y3 function as temperature areas of the heating portions KN1-KN3, respectively.

The liquid transport chip CSC and the process chip CRC are formed on different substrates. When the liquid transport chip CSC and the process chip CRC are overlapped with each other to be integral with each other, the connection chambers RS21 and RS22 are connected to the connection chambers RS23 and RS24, respectively, causing the channels RR to be closed for providing a closed loop. Thereby, a drive solution, a reagent and a gas within the microfluidic device 1C are shut from outside air.

The micropump MP1 cooperates with the micropump MP2 and thereby a reagent present in any of the chambers Y1-Y3 within the process chamber RY21 moves to the other chambers Y1-Y3. When the micropumps MP1 and MP2 are driven, pressures of gases present in front and in rear of the reagent can be separately adjusted, ensuring that movement or transport of the reagent can be smoothly performed in a precise manner.

The liquid chamber RE12 functions as a tank for reserving a drive solution. A part of the wall surface of the liquid chamber RE12 is preferably structured by a soft material easily transforming, e.g., a resin film as mentioned above in order to prevent the interior of the liquid chamber RE12 from providing a negative pressure when a drive solution in the liquid chamber RE12 is reduced by driving the micropump(s) MP.

Further, the liquid chamber RE12 retains a drive solution having an amount that is sufficiently greater than a movement amount of the drive solution when the micropump(s) MP is driven. Then, a small amount of the drive solution is discharged from respective outlets of the connection chambers RS21 and RS22 at fixed intervals or every time when a test or an examination is carried out, leading to the improved maintenance.

One liquid chamber RE12 is shared by the two micropumps MP1 and MP2. Instead, a structure is possible in which each of the micropumps MP1 and MP2 has a liquid chamber RE or a tank individually and the liquid chambers RE or the tanks are not in communication with each other.

Since the two micropumps MP1 and MP2 are used, each of the micropumps MP1 and MP2 may transport a liquid unidirectionally. Alternatively, any one of the micropumps MP1 and MP2 may be omitted so that only one micropump MP, which is drivable bidirectionally, is used for drive.

The microfluidic device 1C according to the third embodiment shown in FIG. 14 corresponds to the microfluidic device 1B according to the second embodiment shown in FIG. 13. The microfluidic device 1C according to the third embodiment shown in FIG. 14 can be in the form corresponding to the microfluidic device 1 according to the first embodiment shown in FIGS. 8 and 11. Such an example is illustrated in FIG. 15.

Figure 15:
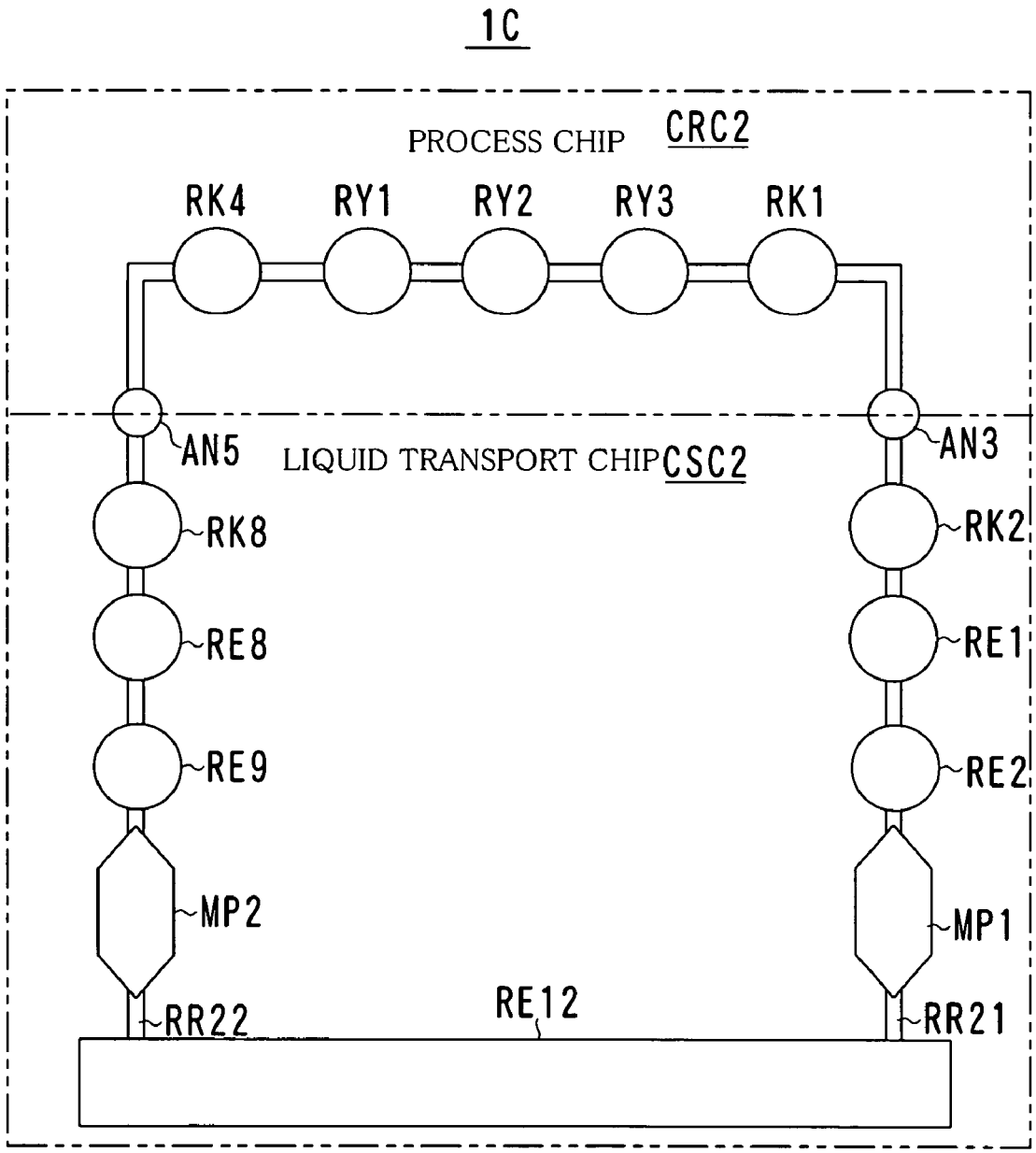
FIG. 15 shows a modification of the microfluidic device according to the third embodiment.

FIG. 15 shows a modification of the microfluidic device 1C according to the third embodiment.

As shown in FIG. 15, a liquid transport chip (a drive chip) CSC2 and a process chip CRC2 are formed on different substrates. The liquid transport chip CSC2 and the process chip CRC2 are overlapped with each other and integral with each other so as to be in communication with each other by connection holes AN3 and AN5. The structure of the liquid transport chip CSC2 is almost similar to that of the liquid transport chip CSC shown in FIG. 14. The structure of the process chip CRC2 is similar to the structure extending from the gas chamber RK1 to the gas chamber RK4 including the process chambers RY1-RY3 shown in FIG. 8. The process chip CRC2 is provided with a heating portion if necessary.

Various methods can be adopted for observation of a result after performing a test on a reagent or of a state during performing a test on a reagent. In the case where a part of the structure of the process chamber RY2 is made transparent, a reagent is optically detected in the part. Fluorescence detection is generally used for the detection.

Figure 16:
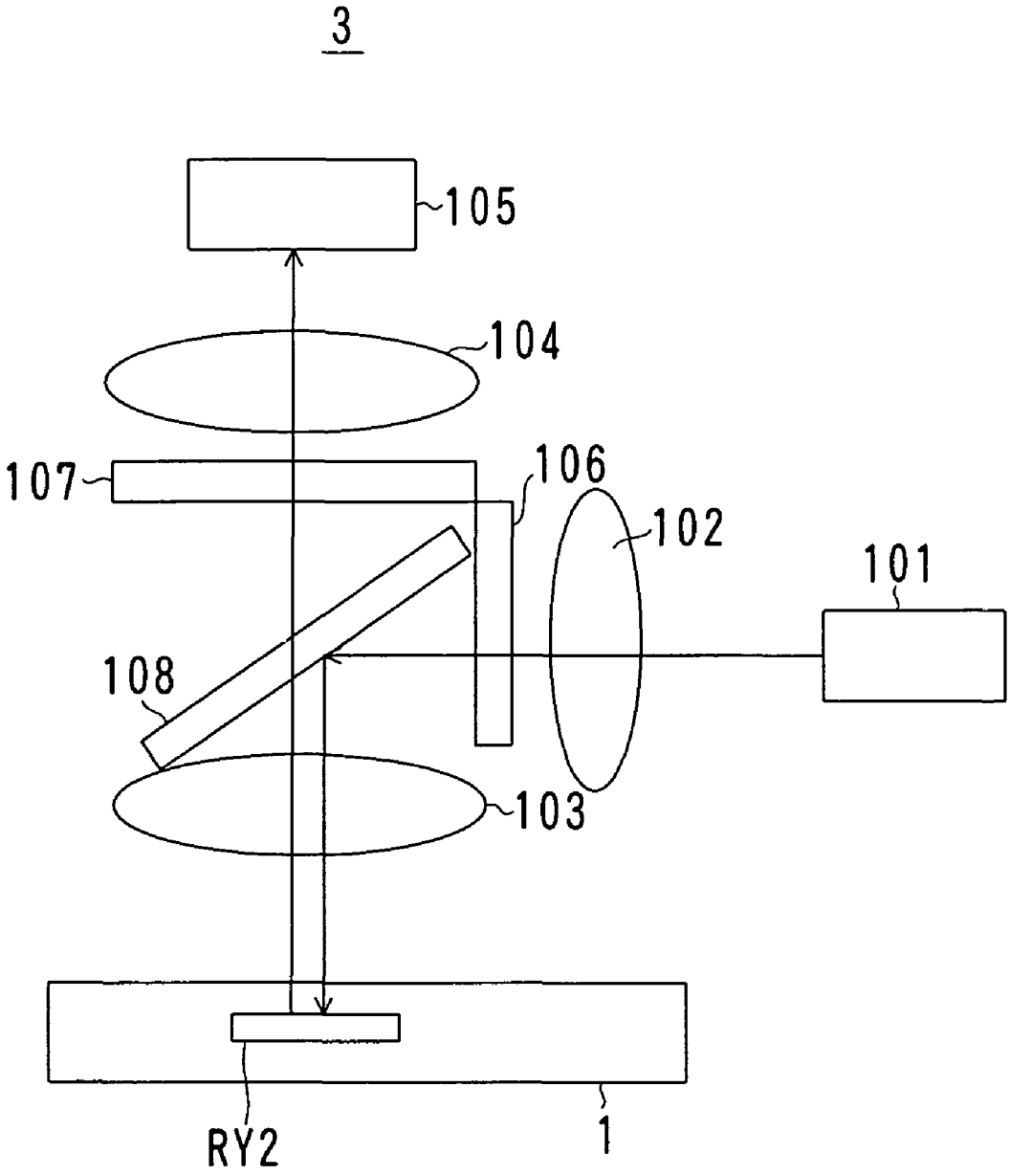
FIG. 16 PRIOR ART
FIG. 16 is a diagram showing an example of a structure of a coaxial incident light optical device used for optical detection.

FIG. 16 is a diagram showing an example of a structure of a known coaxial incident light optical device 3 used for optical detection of a reagent in the process chamber RY2.

Referring to FIG. 16, the coaxial incident light optical device 3 includes a light source 101, lenses 102-104, a detector 105, bandpass filters 106-107 and a dichroic mirror 108.

The light source 101 projects excitation light which is irradiated to a reagent in the process chamber RY2 through the lens 102, the bandpass filter 106, the dichroic mirror 108 and the lens 103. In response to the irradiated light, a fluorescent material included in the reagent produces fluorescence. The fluorescence is detected by the detector 105 through the lens 103, the dichroic mirror 108, the bandpass filter 107 and the lens 104. The projected excitation light illuminates the interior of the process chamber RY2. A field stop (not shown) positioned right in front of the detector 105 sets a measurement field of a detection optical system so as to receive fluorescence from within an irradiation range of the projected excitation light.

As discussed above, according to the microfluidic device 1, 1B or 1C in the first, the second or the third embodiment, it is possible to measure or observe a state or the course during performing a test on a reagent in addition to a test result of a reagent.

According to each of the embodiments, the microfluidic devices 1, 1B and 1C for testing a reagent can be downsized. Since volumes of channels where a reagent or others moves can be reduced, a test is possible using a small amount of reagent and responsiveness to movement and to a temperature process is good. Positioning after movement of a reagent can be accurately performed with precision, which enables a test with precision.

Additionally, the expensive liquid transport chip CS can be used permanently, while the inexpensive process chip CR is disposable. A trouble for washing the process chip CR can be saved, resulting in the reduced running cost.

In the respective embodiments described above, constitutions, structures, shapes, dimensions, numbers and materials of each part or whole part of the microfluidic devices 1, 1B and 1C can be varied within the scope of the present invention.

Structures, shapes, dimensions, numbers and materials of each part or whole part of the microfluidic system can be varied within the scope of the present invention.

The microfluidic system discussed above can apply to test of reagents or processes thereof in various fields including environment, food product, biochemistry, immunology, hematology, a genetic analysis, a synthesis and drug development.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A system for distributing a reagent in a channel formed on a chip of a microfluidic device to perform a test on the reagent, the system comprising:

the microfluidic device including:

a fill port formed on the chip to inject the reagent into at least one of the channels;

one or more test portions for performing a test on the reagent injected into the channel; and a micropump capable of transporting a liquid in forward and backward directions in one end portion of the channel, wherein an inside of the micropump and a vicinity of the channel connecting to an inlet and an outlet of the micropump are filled with a drive solution that is only one kind of a liquid driven by the micropump and that has physical properties different from physical properties of the reagent, a gas is sealed between the reagent and the drive solution in the channel to prevent the reagent from contacting the drive solution directly, and the micropump directly drives the drive solution in the forward and backward directions, so that the reagent is repeatedly moved to the test portions through the gas in an indirect manner or is repeatedly passed through the test portions through the gas in an indirect manner.

2. The system according to claim 1, wherein the chip includes a process chip in which a first channel for distributing the reagent is provided, and a drive chip in which a second channel for transporting the drive solution, the test portions and the micropump are provided, the process chip is removably attached to the drive chip, and the gas passes through a connection portion of the first channel and the second channel.

3. The system according to claim 1, wherein the test portions are three heating portions having different temperatures, and the device is configured to be able to move the reagent repeatedly to the three heating portions in a sequential manner.

4. The system according to claim 3, wherein the channel is provided with three reagent chambers corresponding to positions of the three heating portions, the reagent chambers being for containing the reagent, and the reagent is capable of being moved to the reagent chambers to be contained therein sequentially.

5. The system according to claim 4, wherein the reagent chambers are equal to one another in volume and the volume is set so as to be greater than a volume of the reagent that is injected at one time.

6. The system according to claim 5, wherein the microfluidic device is configured to drive a transport volume of the drive solution at one time equal to a sum of the volumes of the reagent chambers and a volume of the channel connecting the two reagent chambers.

7. The system according to claim 4, wherein each of the reagent chambers is provided with two electrodes for detecting whether or not the reagent is contained.

8. The system according to claim 4, wherein an inner circumferential surface of each of the channels connecting the reagent chambers is treated with a water repellent or an oil repellent.

9. The system according to claim 1, further comprising a gas chamber in the other end of the channel, the gas chamber supplying a gas to the channel when the reagent injected into the channel moves to the micropump side.

10. The system according to claim 9, wherein at least one wall surface of the gas chamber is made of a film-like material that has flexibility and freely transforms.

11. The system according to claim 1, further comprising a drive solution chamber in the channel connected to the liquid inlet and the liquid outlet opposite to the reagent of the micropump, the drive solution chamber containing the drive solution transported from the micropump.

12. The system according to claim 11, wherein at least one wall surface of the gas chamber is made of a film-like material that has flexibility and freely transforms.

13. The system according to claim 1, wherein said system further comprises an optical device configured to detect a result after performing the test on the reagent or a state while performing the test on the reagent.

14. A system for distributing a reagent in a channel formed on a chip of a microfluidic device to perform a test on the reagent, the system comprising:

the microfluidic device including:

a reagent chamber formed on the chip to contain the reagent;

a plurality of process chambers divided within the reagent chamber;

a plurality of test portions for performing a test on the reagent, the test portions corresponding to the process chambers; and a micropump capable of transporting a liquid in forward and backward directions in one end portion of the channel, wherein an inside of the micropump and a vicinity of the channel connecting to an inlet and an outlet of the micropump are filled with a drive solution that is only one kind of a liquid driven by the micropump and that has physical properties different from physical properties of the reagent, a gas is sealed between the reagent and the drive solution in the channel to prevent the reagent from contacting the drive solution directly, and the micropump directly drives the drive solution in the forward and backward directions, so that the reagent is moved in the reagent chamber through the gas indirectly, causing the reagent to move to the plurality of process chambers sequentially.

15. The system according to claim 14, wherein the chip includes three heating portions so as to correspond to the reagent chamber, the reagent chamber is divided into three process chambers corresponding to the three heating portions, and the reagent is moved in the reagent chamber, so that the reagent moves to the three heating portions sequentially.

16. A system for distributing a reagent in a channel formed on a chip of a microfluidic device to perform a test on the reagent, the system comprising:

the microfluidic device including:

a fill port formed on the chip to inject the reagent into at least one of the channels;

one or more test portions for performing a test on the reagent injected into the channel; and a micropump provided at least one point of the channel to be capable of transporting a liquid in forward and backward directions, wherein an inside of the micropump and a vicinity of the channel connecting to an inlet and an outlet of the micropump are filled with a drive solution that is only one kind of a liquid driven by the micropump and that has physical properties different from physical properties of the reagent, a gas is sealed between the reagent and the drive solution in the channel to prevent the reagent from contacting the drive solution directly, the channel is wholly closed in the form of a loop, and the micropump directly drives the drive solution in the forward and backward directions, so that the reagent is repeatedly moved to the test portions through the gas in an indirect manner or is repeatedly passed through the test portions through the gas in an indirect manner.

17. A system for distributing a reagent in a reagent channel to perform a test on the reagent, the system comprising:

the microfluidic device including:

a substrate having a bonding surface for bonding a process chip having the reagent channel, the substrate including a connection portion for connecting to the reagent channel in the process chip, a drive channel extending from the connection portion, a micropump that is positioned at an end portion of the drive channel and is capable of transporting a liquid in forward and backward directions, and one or more test portions that are provided at positions corresponding to the reagent when the process chip is bonded and perform a test on the reagent, wherein an inside of the micropump and a vicinity of the drive channel connecting to an inlet and an outlet of the micropump are filled with a drive solution that is only one kind of a liquid driven by the micropump and that has physical properties different from physical properties of the reagent, a gas is sealed in the drive channel between the connection portion and the drive solution, and when the process chip is bonded, the micropump transports the drive solution in the forward and backward directions, so that the reagent is distributed in the reagent channel in the forward and backward directions through the gas in an indirect manner, causing the reagent to be repeatedly moved to the test portions or to be repeatedly passed through the test portions.

18. The system according to claim 17, wherein the test portions are three heating portions having different temperatures, and the micropump is driven to repeatedly move the reagent to the three heating portions in a sequential manner.

19. A system for distributing a reagent in a channel formed on a microfluidic device to perform a test on the reagent, the system comprising:

the microfluidic device; and a detection device for detecting a state of the reagent in the channel, the microfluidic device including one or more test portions for performing a test on the reagent injected into the channel, and a micropump capable of transporting a liquid in forward and backward directions in one end portion of the channel, wherein an inside of the micropump and a vicinity of the channel connecting to an inlet and an outlet of the micropump are filled with a drive solution that is only one kind of a liquid driven by the micropump and that has physical properties different from physical properties of the reagent, a gas is sealed between the reagent and the drive solution in the channel to prevent the reagent from contacting the drive solution directly, the micropump directly drives the drive solution in the forward and backward directions, so that the reagent is repeatedly moved to the test portions through the gas in an indirect manner or is repeatedly passed through the test portions through the gas in an indirect manner, and the detection device detects a state of the reagent.

20. The system according to claim 19, wherein the test portions are three heating portions having different temperatures, and the micropump is driven to repeatedly move the reagent to the three heating portions in a sequential manner, so that a gene included in the reagent is amplified by a PCR method.

21. A system for performing a test on a reagent, the system comprising:

a microfluidic device including:

a channel formed on a chip to distribute the reagent;

one or more test portions for performing a test on the reagent;

a micropump capable of transporting a liquid in forward and backward directions in one end portion of the channel;

a drive solution that is only one kind of a liquid driven by the micropump and that has physical properties different from physical properties of the reagent filled in the micropump and the channel in a vicinity of a liquid inlet and a liquid outlet of the micropump; and a gas for transport that is sealed between the reagent and the drive solution to prevent the reagent from contacting the drive solution directly, wherein the micropump drives the drive solution in the forward and backward directions, so that the reagent is moved in the channel through the gas, is passed through the test portions through the gas or is moved to the test portions through the gas, and the test portions perform the test on the reagent when the reagent passes through the test portions or moves to the test portions.

22. A method of operating a microfluidic device, said microfluidic device having:

(i) a substrate having a cavity disposed therein, (ii) a micropump disposed in said cavity and configured to pump a drive solution in either a forward or a backward direction, and (iii) a plurality of drive solution chambers disposed in said cavity with at least one of said chambers connected on the upstream side of said micropump and at least one of said chambers connected to an outlet of said micropump, (iv) a plurality of test chambers disposed along said cavity upstream from the at least one of said drive solution chambers on the upstream side of the micropump, at least one of said test chambers having an opening for receiving a fluid, said method comprising:

introducing a drive solution into said micropump and into said cavity in a vicinity upstream and downstream from said micropump;

introducing a fluid into the cavity in such a manner that a gas bubble is established between the fluid and the drive solution; and driving said micropump in a forward and a backward direction such that the fluid is moved between a most distant and a most proximate test chamber relative to said micropump by pumping only drive solution with said micropump.

23. The method according to claim 22 further comprising:

driving with the micropump a transport volume of the drive solution at one time equal to the volume of one of the test chambers such that driving the transport volume will cause the fluid to be moved either forward or backward by one whole test chamber at a time.

24. The method according to claim 22, wherein said microfluidic device further has:

(v) a plurality of heating portions being associated with said test chambers and each being capable of heating to different temperatures, said method further comprising:

driving said micropump in the forward and backward directions such that the fluid repeatedly moves between the heating portions in a sequential manner.

* * * * *